US007527923B2

(12) United States Patent
Ikari

(10) Patent No.: US 7,527,923 B2
(45) Date of Patent: May 5, 2009

(54) SILVER HALIDE COLOR LIGHT-SENSITIVE MATERIAL

(75) Inventor: Shinji Ikari, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/664,103

(22) PCT Filed: Sep. 29, 2005

(86) PCT No.: PCT/JP2005/018493

§ 371 (c)(1),
(2), (4) Date: Mar. 29, 2007

(87) PCT Pub. No.: WO2006/036011

PCT Pub. Date: Apr. 6, 2006

(65) Prior Publication Data

US 2008/0124664 A1 May 29, 2008

(30) Foreign Application Priority Data

Sep. 30, 2004 (JP) ..... 2004-288580

(51) Int. Cl.
*G03C 1/005* (2006.01)
*G03C 1/494* (2006.01)
*G03C 1/06* (2006.01)
*G03C 1/46* (2006.01)

(52) U.S. Cl. ..... 430/564; 430/567; 430/502; 430/503; 430/504; 430/505; 430/506; 430/599; 430/604; 430/605

(58) Field of Classification Search ..... 430/502–506, 430/567, 599, 604–605, 564
See application file for complete search history.

(56) References Cited

U.S. PATENT DOCUMENTS

| | | | | |
|---|---|---|---|---|
| 6,232,050 | B1 | 5/2001 | Hirai et al. | |
| 7,332,265 | B2 * | 2/2008 | Matsumoto et al. | 430/505 |
| 2004/0115570 | A1 | 6/2004 | Yokozawa et al. | |
| 2004/0157175 | A1 | 8/2004 | Matsumoto et al. | |

FOREIGN PATENT DOCUMENTS

| | | | |
|---|---|---|---|
| JP | 10-111548 | A | 4/1998 |
| JP | 11-84555 | A | 3/1999 |
| JP | 11-305396 | A | 11/1999 |
| JP | 2002-351028 | A | 12/2002 |
| JP | 2003-195460 | A | 7/2003 |
| JP | 2004-157478 | A | 6/2004 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material, having photographic constituting layers including, on a support, at least one blue-sensitive layer containing a silver halide emulsion, at least one green-sensitive layer containing a silver halide emulsion, at least one red-sensitive layer containing a silver halide emulsion, and at least one hydrophilic colloidal layer, in which a silver chloride content is 95 mol % or more and a silver iodide content is from 0.05 to 0.3 mol % in the silver halide emulsion of the red-sensitive layer, and in which the difference between spectral sensitivities at wavelength of 685 nm and 590 nm is from 1.2 to 2.5 log E or the difference between spectral sensitivities at wavelength of 660 nm and 590 nm is 0.8 to 2.0 log E, for a distribution of the spectral sensitivities when the material is exposed to lights equal in energy at each wavelength.

23 Claims, No Drawings

SILVER HALIDE COLOR LIGHT-SENSITIVE MATERIAL

TECHNICAL FIELD

The present invention relates to a silver halide color light-sensitive material.

BACKGROUND ART

In recent years, digitalization has been remarkably propagated in the field of a color print using a color printing paper. For example, a digital exposure system by laser scanning exposure has been rapidly spread in comparison with a conventional analog exposure system of directly conducting a printing from a processed color negative film using a color printer. Such a digital exposure system is characterized in that a high image quality is obtained by conducting image processing, and it greatly contributes to improvement of qualities of color prints using a color printing paper. Also, along with the rapid spread of digital cameras, an important factor is to simply obtain color prints with high image quality from these electronic recording media. It is believed that they will lead to further remarkable popularization. On the other hand, as a color print method, techniques, such as an ink jet method, a sublimated type method, and color xerography, have each progressed and are recognized for their ability of providing comparable image qualities to photography. Compared with these techniques, characteristics of the digital exposure method using a color printing paper reside in high image quality, high throughput, and high solidity (fastness) of an image. It is desired to provide high image quality photographs more easily and with lower cost by further developing these characteristics.

In the digital exposure of a light-sensitive material for the color printing paper, three kinds of laser sources, each having a different wavelength and sensitizing a blue-sensitive layer, a green-sensitive layer, or a red-sensitive layer, and the like can be used. Among these layers, the red-sensitive layer can be exposed to light using a laser light source having a wavelength of 685 nm or 660 nm. The color printing paper is sometimes handled under an extremely weak light (safelight) having a wavelength of from 580 to 600 nm. The wavelength of the safelight falls in a trough between the respective absorption wavelengths of the green-sensitive layer and the red-sensitive layer, and it affects the green-sensitive layer and the red-sensitive layer; in particularly it greatly affects the sensitivity of the red-sensitive layer. As the difference between the sensitivity to the wavelength of light from the laser light source and the sensitivity to the wavelength of safelight is increased, a dynamic range is retained, making it possible to obtain a light-sensitive material reduced in influence of safelight. Also, this red-sensitive layer has the problem that it largely varies in sensitivity by a change in the condition of exposure.

When a laser light source is used to carry out light exposure, there is a limitation to the range of exposure amount because of the device limit. It is, therefore, important that a light-sensitive material be more contrasty in a prescribed amount of exposure when intending to obtain a wide optical density range.

A method of introducing a desensitizing gradation-hardening dopant into silver halide grains is included as an example of methods to obtain contrasty light-sensitive materials. The desensitizing gradation-hardening dopant traps the electrons excited by light exposure, to reduce fluctuation corresponding to the amount of the light exposure, thereby eliminating the dispersion of qualities between grains in the silver halide grains, whereby a contrasty light-sensitive material can be attained. In this case, an increase in the amount of the desensitizing gradation-hardening dopant is accompanied by large desensitization, and therefore, this dopant is used in a very small amount. Light-sensitive materials into which this desensitizing gradation-hardening dopant is introduced have the problem that these materials are easily affected by even extremely weak light, such as safelight. These light-sensitive materials also have the problem that they vary in sensitivity when they are exposed to light at a low temperature.

It is known to define the sensitivity to a specific wavelength or the relation between the sensitivities to specific multiple wavelengths, for the light-sensitive material. For example, a method of preventing color mixing to obtain a high-quality image in the case of color printing paper (see JP-A-10-111548 ("JP-A" means unexamined published Japanese patent application)), and a method of making use of an interlayer effect efficiently in the case of color negative films or color reversal films (see JP-A-11-84555, JP-A-11-305396, and JP-A-2002-351028), are proposed.

There has been a need to attain sensitivity enhancement, gradation hardening, and reduction in the variation of sensitivity which is caused by the variations of light exposure conditions and safelight as described above, at the same time.

DISCLOSURE OF INVENTION

According to the present invention, there are provided the following means:

(1) A silver halide color photographic light-sensitive material, having photographic constituting layers including at least one blue-sensitive layer containing a silver halide emulsion, at least one green-sensitive layer containing a silver halide emulsion, at least one red-sensitive layer containing a silver halide emulsion, and at least one hydrophilic colloidal layer, each of which is provided on a support, wherein a content of silver chloride is 95 mol % or more and a content of silver iodide is 0.05 mol % or more and 0.3 mol % or less in the silver halide emulsion of the red-sensitive layer, and wherein the difference (S1−S2) between a spectral sensitivity (S1) at a wavelength of 685 nm and a spectral sensitivity (S2) at a wavelength of 590 nm is from 1.2 to 2.5 log E, for a distribution of the spectral sensitivities when the light-sensitive material is exposed to lights equal in energy at each wavelength.

(2) A silver halide color photographic light-sensitive material, having photographic constituting layers including at least one blue-sensitive layer containing a silver halide emulsion, at least one green-sensitive layer containing a silver halide emulsion, at least one red-sensitive layer containing a silver halide emulsion, and at least one hydrophilic colloidal layer, each of which is provided on a support, wherein a content of silver chloride is 95 mol % or more and a content of silver iodide is 0.05 mol % or more and 0.3 mol % or less in the silver halide emulsion of the red-sensitive layer, and wherein the difference (S3−S2) between a spectral sensitivity (S3) at a wavelength of 660 nm and a spectral sensitivity (S2) at a wavelength of 590 nm is from 0.8 to 2.0 log E, for a distribution of the spectral sensitivities when the light-sensitive material is exposed to lights equal in energy at each wavelength.

(3) The silver halide color photographic light-sensitive material according to the above item (1) or (2), wherein the content of silver iodide in the silver halide emulsion of the red-sensitive layer is 0.07 mol % or more and 0.3 mol % or less.

(4) The silver halide color photographic light-sensitive material according to the above item (1) or (3), wherein the difference (S1−S2) is from 1.4 to 2.5 log E.

(5) The silver halide color photographic light-sensitive material according to the above item (2) or (3), wherein the difference (S3−S2) is from 1.0 to 2.0 log E.

(6) The silver halide color photographic light-sensitive material according to any one of the above items (1) to (5), wherein silver halide grains in the silver halide emulsion of the red-sensitive layer contain an iridium complex represented by formula (1):

$$[Ir(X^I)_m(L^I)_{(6-m)}]^n \qquad \text{Formula (1)}$$

wherein $X^I$ represents a halogen ion or a pseudo halogen ion other than a cyanate ion; $L^I$ represents an arbitrary ligand differing from $X^I$; m represents 3, 4, or 5; and n represents 5−, 4−, 3−, 2−, 1−, 0, or 1+.

(7) The silver halide color photographic light-sensitive material according to any one of the above items (1) to (6), wherein silver halide grains in the silver halide emulsion of the red-sensitive layer contain a metal complex represented by formula (2):

$$[M(X^{II})_p(L^{II})_{(6-p)}]^q \qquad \text{Formula (2)}$$

wherein M represents Cr, Mo, Re, Fe, Ru, Os, Co, Rh, Pd, or Pt; $X^{II}$ represents a halogen ion; $L^{II}$ represents an arbitrary ligand differing from $X^{II}$; p represents an integer of from 3 to 6; and q represents 4−, 3−, 2−, 1−, 0, or 1+.

According to the present invention, it is possible to provide a silver halide color light-sensitive material that is contrasty and high in sensitivity, that is reduced in the variation of sensitivity when safelight is applied to the light-sensitive material, and that is also reduced in the variation of sensitivity that is caused by variation in the condition of exposure, in digital exposure, such as laser scanning exposure.

Other and further features and advantages of the invention will appear more fully from the following description.

BEST MODE FOR CARRYING OUT INVENTION

The silver halide color photographic light-sensitive material of the present invention has photographic constituting layers including at least one blue-sensitive layer containing a silver halide emulsion, at least one green-sensitive layer containing a silver halide emulsion, at least one red-sensitive layer containing a silver halide emulsion, and at least one hydrophilic colloidal layer, each of which is provided on a support; in which the content of silver chloride is 95 mol % or more and the content of silver iodide is 0.05 mol % or more and 0.3 mol % or less in the silver halide emulsion of the red-sensitive layer; and in which the difference (S1−S2) between a spectral sensitivity (S1) at a wavelength of 685 nm and a spectral sensitivity (S2) at a wavelength of 590 mm is 1.2 to 2.5 log E (E means an exposure amount in the present specification) or the difference (S3−S2) between a spectral sensitivity (S3) at a wavelength of 660 nm and a spectral sensitivity (S2) at a wavelength of 590 nm is 0.8 to 2.0 log E, for a distribution of the spectral sensitivities when the light-sensitive material is exposed to lights equal in energy at each wavelength.

The present invention will be explained in detail.

The silver halide color light-sensitive material of the present invention can be exposed to lights equal in energy at each wavelength to measure the distribution of equi-energy spectral sensitivity which is obtained by linking the points having the same densities at each density falling in the range of analysis density of 1.0 or more and 2.0 or less. From this distribution, a spectral sensitivity at which the analysis density obtained by the specific wavelength is reached can be found. In the present invention, a difference in exposure amounts at the wavelengths of laser (685 nm or 660 nm) and safelight (590 nm) when the analysis density is 1.0 is expressed by a unit of log E, which takes on a positive value when the light-sensitive material is highly sensitive.

In the present invention, the difference (S1−S2) between a spectral sensitivity (S1) at 685 nm and a spectral sensitivity (S2) at 590 nm is preferably 1.2 to 2.5 log E, and more preferably 1.4 to 2.5 log E. Also, the difference (S3−S2) between a spectral sensitivity (S3) at 660 nm and a spectral sensitivity (S2) at 590 nm is preferably 0.8 to 2.0 log E, and more preferably 1.0 to 2.0 log E. Further, in the present invention, it is further preferable that the difference (S1−S2) is 1.2 to 2.5 loge and the difference (S3−S2) is 0.8 to 2.0 log E, and furthermore preferable that the difference (S1−S2) is 1.4 to 2.5 loge and the difference (S3−S2) is 1.0 to 2.0 log E.

The silver halide emulsion used in the present invention will be explained.

It is preferably that the content of silver chloride in the silver halide grains of the silver halide emulsion used in the present invention be 95 mol % or more, to carry out rapid processing for the purpose of achieving high productivity. The silver chloride content is more preferably 95 mol % to 99.5 mol %, and further preferably 95 mol % to 98.5 mol %. However, in the present invention, the silver halide emulsion of the red-sensitive layer has a silver chloride content of 95 mol % or more, preferably 95 mol % to 99.5 mol %, and further preferably 95 mol % to 98.5 mol %. At this time, silver chlorobromide, silver chloroiodide or silver chloroiodobromide grains which are mixed crystals obtained by combining with silver bromide and/or silver iodide are preferably used. The content of silver bromide is preferably 0.25 mol % to 10 mol %, and further preferably 1 mol % to 4 mol %. It is preferable that the content of silver iodide be 0.05 mol % to 0.3 mol %, and further preferably 0.07 mol % to 0.3 mol %. However, in the present invention, the silver halide emulsion of the red-sensitive layer has a silver iodide content of 0.05 mol % or more and 0.3 mol % or less, and preferably 0.07 mol % or more and 0.3 mol % or less.

Since the silver halide emulsion used in the present invention has a high silver chloride content, sensitivity reduction and gradation softening are easily caused by high intensity exposure such as a laser scanning exposure. In order to solve this problem, the silver halide grains used in the present invention, further preferably the silver halide grains in the silver halide emulsion of the red-sensitive layer, preferably contain an iridium complex represented by formula (1).

$$[Ir(X^I)_m(L^I)_{(6-m)}]^n \qquad \text{Formula (1)}$$

In formula (1), $X^I$ represents a halogen ion or a pseudo halogen ion other than a cyanate ion; $L^I$ represents an arbitrary ligand differing from $X^I$; m represents 3, 4 or 5; and n represents 5−, 4−, 3−, 2−, 1−, 0, or 1+.

Here, from 3 to 5 $X^I$s may be the same or different from each other. When plural $L^I$s exist, these plural $L^I$s may be the same or different from each other.

In formula (1), the pseudo halogen ion (halogenoide) is an ion having a nature similar to that of halogen ion, and can include, for example, cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$), fulminate ion ($ONC^-$), and azide ion ($N_3^-$).

$X^I$ is preferably a fluoride ion, a chloride ion, a bromide ion, an iodide ion, a cyanide ion, an isocyanate ion, a thiocyanate ion, a nitrate ion, a nitrite ion, or an azide ion. Among these, a chloride ion and a bromide ion are particularly preferable. $L^I$ has no particular limitation, and it may be an organic or inorganic compound that may or may not have a charge, with organic or inorganic compounds with no charge being preferable.

Among the metal complexes represented by formula (1), a metal complex represented by formula (1A) is preferred.

$$[Ir(X^{IA})_m(L^{IA})_{(6-m)}]^n \quad \text{Formula (1A)}$$

In formula (1A), $X^{IA}$ represents a halogen ion or a pseudo halogen ion other than a cyanate ion; $L^{IA}$ represents an arbitrary inorganic ligand differing from $X^{IA}$; m represents 3, 4 or 5; and n represents 4−, 3−, 2−, 1−, 0, or 1+.

In formula (1A), $L^{IA}$ has the same meaning as $L^I$ in formula (1), and a preferable range is also identical. $L^{IA}$ is preferably $H_2O$ (water), OCN, ammonia, phosphine or carbonyl, with water being particularly preferable.

Here, from 3 to 5 $X^{IA}$s may be the same or different from each other. When plural $L^{IA}$s exist, these plural $L^{IA}$s may be the same or different from each other.

Among the metal complexes represented by formula (1), a metal complex represented by formula (1B) are further preferred.

$$[Ir(X^{IB})_m(L^{IB})_{(6-m)}]^n \quad \text{Formula (1B)}$$

In formula (1B), $X^{IB}$ represents a halogen ion or a pseudo halogen ion other than a cyanate ion; $L^{IB}$ represents a ligand having a chain or cyclic hydrocarbon as a basic structure, or in which a portion of carbon atoms or hydrogen atoms of the basic structure is substituted with other atoms or atom groups; m represents 3, 4 or 5; and n represents 4−, 3−, 2−, 1−, 0, or 1+.

In formula (1B), $X^{IB}$ has the same meaning as $X^I$ in formula (1), and a preferable range is also identical. $L^{IB}$ represents a ligand having a chain or cyclic hydrocarbon as a basic structure, or in which a portion of carbon atoms or hydrogen atoms of the basic structure is substituted with other atoms or atom groups, but it does not include a cyanide ion. $L^{IB}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Here, from 3 to 5 $X^{IB}$s may be the same or different from each other. When plural $L^{IB}$'s exist, these plural $L^{IB}$s may be the same or different from each other.

Among the metal complexes represented by formula (1B), a metal complex represented by formula (1C) is more preferred.

$$[Ir(X^{IC})_m(L^{IC})_{(6-m)}]^n \quad \text{Formula (1C)}$$

In formula (1C), $X^{IC}$ represents a halogen ion or a pseudo halogen ion other than a cyanate ion; $L^{IC}$ represents a 5-membered ring ligand having at least one nitrogen atom and at least one sulfur atom in its ring skeleton that may have an arbitrary substituent on the carbon atoms in said ring skeleton; m represents 3, 4 or 5; and n represents 4−, 3−, 2−, 1−, 0, or 1+.

In formula (1C), $X^{IC}$ has the same meaning as $X^I$ in formula (1), and a preferable range is also identical. The substituent on the carbon atoms in said ring skeleton in $L^{IC}$ is preferably a substituent having a smaller volume than n-propyl group. Preferable substituents are a methyl group, an ethyl group, a methoxy group, an ethoxy group, a cyano group, an isocyano group, a cyanate group, an isocyanate group, a thiocyanate group, a isothiocyanate group, a formyl group, a thioformyl group, a hydroxy group, a mercapto group, an amino group, a hydrazino group, an azide group, a nitro group, a nitroso group, a hydroxyamino group, a carboxyl group, a carbamoyl group, a fluoride group, a chloride group, a bromide group and an iodide group.

Here, from 3 to 5 $X^{IC}$s may be the same or different from each other. When plural $L^{IC}$s exist, these plural $L^{IC}$s may be the same or different from each other.

Preferable specific examples of the metal complexes represented by formula (1) are shown below. However, the present invention is not limited to these complexes.

$[IrCl_5(H_2O)]^{2-}$
$[IrCl_4(H_2O)_2]^-$
$[IrCl_5(H_2O)]^-$
$[IrCl_4(H_2O)_2]^0$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^-$
$[IrBr_5(H_2O)]^-$
$[IrBr_4(H_2O)_2]^0$
$[IrBr_5(OH)]^{3-}$
$[IrBr_4(OH)_2]^{2-}$
$[IrBr_5(OH)]^{2-}$.
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(\text{thiazole})]^{2-}$
$[IrCl_4(\text{thiazole})_2]^-$
$[IrCl_3(\text{thiazole})_3]^0$
$[IrBr_5(\text{thiazole})]^{2-}$
$[IrBr_4(\text{thiazole})_2]^-$
$[IrBr_3(\text{thiazole})_3]^0$
$[IrCl_5(\text{5-methylthiazole})]^{2-}$
$[IrCl_4(\text{5-methylthiazole})_2]^-$
$[IrBr_5(\text{5-methylthiazole})]^{2-}$
$[IrBr_4(\text{5-methylthiazole})_2]^-$ It is further preferable that the silver halide grains in the silver halide emulsion used in the present invention contain a six coordination complex having 6 ligands, all of which are Cl, Br or I, and iridium as a central metal. In this case, Cl, Br or I may be a mixture of them in the six-coordination complex. The six-coordination complex having Cl, Br or I as a ligand, and iridium as a central metal is particularly preferably incorporated in a silver bromide-containing phase in order to obtain hard gradation upon high illuminance exposure.

Specific examples of the six-coordination complex having Cl, Br or I as a ligand, and iridium as a central metal are shown below. However, the iridium complex that can be used in the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

These iridium complexes are preferably added during grain formation in an amount of $1\times10^{-10}$ mol to $1\times10^{-3}$ mol, and most preferably $1\times10^{-8}$ mol to $1\times10^{-5}$ mol, per mol of silver.

It is also preferable that the silver halide grains used in the present invention, further preferably the silver halide grains in the silver halide emulsion of the red-sensitive layer, contains a metal complex represented by formula (2).

$$[M(X^{II})_p(L^{II})_{(6-p)}]^q \qquad \text{Formula (2)}$$

In formula (2), M represents Cr, Mo, Re, Fe, Ru, Os, Co, Rh, Pd, or Pt; $X^{II}$ represents a halogen ion; $L^{II}$ represents an arbitrary ligand differing from $X^{II}$; p represents an integer of from 3 to 6; and q represents 4−, 3−, 2−, 1−, 0, or 1+.

In formula (2), $X^{II}$ is preferably a fluoride ion, a chloride ion, a bromide ion or an iodide ion. Of these ions, chloride ion and bromide ion are particularly preferable. $L^{II}$ may be an organic or inorganic compound, and may have a charge or have no charge, so long as it is an arbitrary ligand different from $X^{II}$, inorganic compounds with no charge being preferred. $L^{II}$ is preferably $H_2O$, NO or NS.

Of these metal complexes represented by formula (2), a metal complex represented by formula (2A) is preferred.

$$[(M^{IIA})(X^{IIA})_p(L^{IIA})_{(6-p)}]^q \qquad \text{Formula (2A)}$$

In formula (2A), $M^{IIA}$ represents Re, Ru, Os, or Rh; $X^{IIA}$ represents a halogen ion; $L^{IIA}$ represents NO or NS, when $M^{IIA}$ is Re, Ru, or Os, while $L^{IIA}$ represents $H_2O$, OH, or O, when $M^{IIA}$ is Rh; p represents an integer of from 3 to 6; and q represents 4−, 3−, 2−, 1−, 0, or 1+.

$X^{IIA}$ in formula (2A) has the same meaning as $X^{II}$ of formula (2).

Preferable specific examples of the metal complexes represented by formula (2) are shown below. However, the present invention is not limited to these complexes.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{2-}$
$[RhBr_5(H_2O)]^{2-}$
$[RhBr_4(H_2O)_2]^{2-}$
$[PdCl_6]^{2-}$
$[PtCl_6]^{2-}$

These metal complexes are preferably added during grain formation in an amount of $1\times10^{-11}$ mol to $1\times10^{-3}$ mol, most preferably $1\times10^{-9}$ mol to $1\times10^{-6}$ mol, per mol of silver.

When the foregoing iridium complexes and metal complexes that can be used in the present invention are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable. These metal complexes can be used by being dissolved in water or a mixed solvent of water and an appropriate water-miscible organic solvent (such as alcohols, ethers, glycols, ketones, esters and amides).

In the present invention, it is preferable that the above-mentioned iridium complex and metal complex are incorporated into the silver halide grains, by directly adding the same to a reaction solution during the formation of the silver halide grains, or to an aqueous solution of the halide for the formation of the silver halide grains, or to another solution and then to the reaction solution for the grain formation. It is also preferable that the iridium complex is incorporated into the silver halide grains by physical ripening with fine grains having iridium complex previously incorporated therein. Further, these complexes can be also contained into the silver halide grains by a combination of these methods.

In case where these complexes are doped (incorporated) into the silver halide grains, these complexes are preferably uniformly distributed in the inside of the grains. On the other hand, as disclosed in JP-A-4-208936, JP-A-2-125245 and JP-A-3-188437, these complexes are also preferably distributed only in the grain surface layer. Alternatively, these complexes are also preferably distributed only in the inside of the grains while the grain surface is covered with a layer free from these complexes. Further, as disclosed in U.S. Pat. Nos. 5,252,451 and 5,256,530, it is also preferred that the silver halide grains are subjected to physical ripening in the presence of fine grains having these complexes incorporated therein, to modify the grain surface phase. Further, these methods may be used in combination. Two or more kinds of complexes are preferably incorporated in the inside of an individual silver halide grain. The halogen composition at the position (portion) where the complexes are incorporated, is not particularly limited, but the six-coordination complex whose central metal is Ir and whose all six-ligands are Cl, Br, or I is preferably incorporated in a silver bromide concentration maximum portion.

The silver halide grains used in the present invention preferably further contain a hexacyano metal complex represented by formula (3).

$$[(M^{III})(CN)_6]^s \qquad \text{Formula (3)}$$

In formula (3), $M^{III}$ represents a metal selected from the group consisting of iron, ruthenium, osmium, cobalt and iridium; and s represents 3− or 4−.

Specific compounds of the complexes represented by formula (3) are shown below. However, the present invention is not limited to these compounds.

$[Fe(CN)_6]^{4-}$
$[Fe(CN)_6]^{3-}$
$[Ru(CN)_6]^{4-}$
$[Os(CN)_6]^{4-}$
$[Co(CN)_6]^{3-}$
$[Ir(CN)_6]^{3-}$

These hexacyano metal complexes are preferably added during grain formation in an amount of $1\times10^{-8}$ mol to $1\times10^{-2}$ mol, further preferably $1\times10^{-7}$ mol to $1\times10^{-3}$ mol, per mol of silver. In case where the hexacyano metal complex is doped (incorporated), they may be uniformly distributed in the inside of the grains. However, the hexacyano metal complex is preferably distributed only in the inside of the grains in a high concentration while the grain surface is covered with a layer free from the complex.

When these hexacyano metal complexes are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable. These metal complexes can be used by being dissolved in water or a mixed solvent of water and an appropriate water-miscible organic solvent (such as alcohols, ethers, glycols, ketones, esters and amides).

The silver halide emulsion will be further explained hereinbelow.

In the present invention, the silver halide emulsion of the red-sensitive layer contains 0.05 to 0.3 mol % of silver iodide. In the following explanations, the silver halide emulsions in the blue-sensitive layer and green-sensitive layer will be explained collectively.

The silver halide emulsion used in the present invention preferably contain specific silver halide grains. The silver halide grains have no particular restriction as to their shapes. It is, however, preferable that the grains are made up of cubic grains having substantially {100} faces, tetradecahedral crystal grains (which may be round in their vertexes and may have higher-order planes), octahedral crystal grains, or tabular grains having principal faces formed of {100} faces or {111} faces and an aspect ratio of 3 or more. The aspect ratio is a value obtained by dividing the diameter of a circle having an area equivalent to the projected area of an individual grain by the thickness of the grain. In particular, cubic crystal grains and tetradecahedral crystal grains are further preferable.

The silver halide grains used in the present invention are preferably silver iodobromochloride grains containing both a silver bromide-containing phase and a silver iodide-containing phase, and particularly preferably silver iodobromochloride grains having the above halogen composition.

The silver halide grains for use in the present invention preferably have a silver bromide-containing phase and/or a silver iodide-containing phase. Herein, a region where the content of silver bromide is higher than that in other regions will be referred to as a silver bromide-containing phase, and likewise, a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The localized silver bromide content in the silver bromide-containing phase is preferably 3 mol % or more, further preferably from 5 to 40 mol %, and most preferably from 5 to 25 mol %. The localized silver iodide content in the silver iodide-containing phase is preferably 0.3 mol % or more, and further preferably from 0.5 to 8 mol %. Such a silver bromide- or silver iodide-containing phase may be present in plural numbers in layer form, within the grain. In this case, the phases may have different silver bromide or silver iodide contents from each other.

The silver bromide-containing phase or silver iodide-containing phase formed in the silver halide layer for use in the present invention, are each preferably formed in a layer form so as to surround the grain. One preferred embodiment is that the silver bromide-containing phase or the silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or an edge of the grain can be different from that of a main plane of the grain. Further, aside from the silver bromide-containing phase and silver iodide-containing phase formed in the layer form so as to surround the grain, another silver bromide-containing phase or silver iodide-containing phase not surrounding the grain may exist in isolation at a specific portion of the surface of the grain.

In a case where the silver halide emulsion for use in the present invention contains a silver bromide-containing phase, it is preferable that said silver bromide-containing phase is formed in a layer form so as to have a concentration maximum of silver bromide inside of the grain. Likewise, in a case where the silver halide emulsion for use in the present invention contains a silver iodide-containing phase, it is preferable that said silver iodide-containing phase is formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide emulsion for use in the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

It is preferable that functions of the silver bromide-containing phase and the silver iodide-containing phase each controlling photographic actions are integrated in the vicinity of the surface of the grain. Accordingly, it is preferred that the silver bromide-containing phase and the silver iodide-containing phase be placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

When the silver halide emulsion for use in the present invention has a silver bromide-containing phase, another suitable mode of the silver halide emulsion having a silver bromide-containing phase is a mode in which the silver halide emulsion has a region ranging in silver bromide content from 0.5 to 20 mol % at a depth of 20 nm or less below the emulsion grain surface. Herein, it is preferable for the silver bromide-containing phase to be at a depth of 10 nm or less below the emulsion grain surface and to range in silver bromide content preferably from 0.5 to 10 mol %, more preferably from 0.5 to 5 mol %. In this case, it is not always required that the silver bromide-containing phase takes a layer form. For maximizing the effects of the present invention, however, it is appropriate that the silver bromide-containing phase be formed in a layer form so as to surround the grain.

When the silver halide emulsion for use in the present invention has a silver iodide-containing phase, another suitable mode of the silver halide emulsion having a silver iodide-containing phase is a mode in which the silver halide emulsion has a region ranging in silver iodide content from 0.3 to 10 mol % at a depth of 20 nm or less below the emulsion grain surface. Herein, it is preferable for the silver iodide-containing phase to be situated at a depth of 10 nm or less below the emulsion grain surface and to range in silver iodide content preferably from 0.5 to 10 mol %, more preferably from 0.5 to 5 mol %. In this case, it is not always required that the silver iodide-containing phase takes a layer form. For maximizing the effects of the present invention, however, it is appropriate that the silver iodide-containing phase be formed in a layer form so as to surround the grain.

In order to introduce bromide ions or iodide ions for making the silver halide emulsion for use in the present invention contain a silver bromide or silver iodide, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high chloride emulsion may be limited. The deeper in the emulsion grain the iodide ion is introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight-Secondary Ion Mass Spectrometry) method by means of, for example, TRIFT II Model TOF-SIMS apparatus (trade name, manufactured by Phi Evans Co.). A TOF-SIMS method is specifically described in, Nippon Hyomen Kagakukai edited, "Hyomen Bunseki Gijutsu Sensho Niji Ion Shitsuryo Bunsekiho (Surface Analysis Technique Selection-Secondary Ion Mass Analytical Method)", Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion for use in the present invention has the maximum concentration of iodide ions at the surface of the grain, that the iodide ion concentration decreases inwardly in the grain, and that the bromide ions preferably have the maximum concentration in the inside of the grain. The local concentration of silver bromide can also be measured with X-ray diffractometry, as long as the silver bromide content is high to some extent.

In the present specification, the sphere-equivalent diameter is indicated by a diameter of a sphere having the same volume as that of individual grain. Emulsion grains for use in the present invention are preferably monodisperse with respect to grain size distribution. The variation coefficient of sphere-equivalent diameter of the all grains in the silver halide emulsion for use in the present invention is preferably 20% or less, more preferably 15% or less, and still more preferably 10% or less. The variation coefficient of sphere-equivalent diameter is expressed as a percentage of standard deviation of sphere-equivalent diameter of each grain, to an average of sphere-equivalent diameter. In this connection, for the purpose of obtaining broad latitude, it is preferred that the above-mentioned monodisperse emulsions be used as blended in the same layer, or coated by a multilayer coating method.

The sphere-equivalent diameter of the silver halide emulsion grains in the silver halide emulsion layer containing a yellow-dye-forming coupler is preferably 0.7 μm or below, further preferably 0.6 μm or below, and most preferably 0.5 μm or below. Both the sphere-equivalent diameter of the silver halide emulsion grains in the silver halide emulsion layer containing a magenta-dye-forming coupler and those in the silver halide emulsion layer containing a cyan-dye-forming coupler are preferably 0.5 μm or below, further preferably 0.4 μm or below, and most preferably 0.3 μm or below. In the present specification, the sphere-equivalent diameter is indicated by a diameter of a sphere having the same volume as that of individual grain. The grain having a sphere-equivalent diameter of 0.6 μm corresponds to a cubic grain having a side length of approximately 0.48 μm, the grain having a sphere-equivalent 0.5 μm corresponds to a cubic grain having a side length of approximately 0.40 μm, the grain having a sphere-equivalent diameter of 0.4 μm corresponds to a cubic grain having a side length of approximately 0.32 μm, and the grain having a sphere-equivalent diameter of 0.3 μm corresponds to a cubic grain having a side length of approximately 0.24 μm. The silver halide emulsion for use in the present invention may contain silver halide grains other than the silver halide grains contained in the silver halide emulsion defined in the present invention (i.e., the specific silver halide grains). In the silver halide emulsion defined in the present invention, however, a ratio of the silver halide grains defined in the present invention in the total projected area of the all silver halide grains is preferably 50% or more, and it is more preferably 80% or more, and still more preferably 90% or more.

The silver halide emulsion for used in the present invention is generally subjected to chemical sensitization. It is preferable to carry out a gold sensitization as the chemical sensitization. The sensitizers and the sensitizing methods preferably used are those disclosed in JP-A-2003-295375, column 14, line 7, to column 28, line 40.

For conducting a chalcogen-gold sensitization, such as selenium-gold sensitization or sulfur-gold sensitization, in the present invention, it is most preferable to use the sensitizers capable of releasing gold-chalcogen anion species as disclosed in U.S. Pat. No. 6,638,705 B1. The compounds preferably used are described as examples of such sensitizers in that publication, and those examples are preferably incorporated herein by reference.

Various compounds or precursors thereof can be added in the silver halide emulsion for use in the present invention to prevent fogging from occurring or to stabilize photographic performance during manufacture, storage or photographic processing of the light-sensitive material. Specific examples of these compounds are disclosed in JP-A-62-215272, pages 39 to 72, and they can be preferably used. In addition, 5-arylamino-1,2,3,4-thiatriazole compounds (the aryl residue has at least one electron-withdrawing group) disclosed in European Patent No. 0447647 can also be preferably used.

Further, in the present invention, to enhance storage stability of the silver halide emulsion, it is also preferred to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Further, spectral sensitizing dyes can be contained in the silver halide emulsion for used in the present invention for the purpose of imparting spectral sensitivity in a desired light wavelength region. Examples of spectral sensitizing dyes used for spectral sensitization of blue, green, or red light region, include those disclosed by F. M. Harmer, in "Heterocyclic Compounds—Cyanine Dyes and Related Compounds", John Wiley & Sons, New York, London (1964). Specific examples of the compounds and spectral sensitization processes include those described in JP-A-62-215272, from page 22, right upper column to page 38. In addition, the spectral sensitizing dyes described in JP-A-3-123340, JP-A-2003-322932 and U.S. Pat. No. 6,531,274 are very preferred as red-sensitive spectral sensitizing dyes, from the viewpoint of stability, adsorption strength, temperature dependency of exposure, and the like.

The amount of these spectral sensitizing dyes to be added can be varied in a wide range depending on the occasion, and it is preferably in the range of $0.5\times10^{-6}$ mol to $1.0\times10^{-2}$ mol, further preferably in the range of $1.0\times10^{-6}$ mol to $5.0\times10^{-3}$ mol, per mole of silver halide.

As described above, the constitution of the silver halide color photographic light-sensitive material of the present invention contains, on a support, at least one yellow-color-forming blue-sensitive silver halide emulsion layer, at least one magenta-color-forming green-sensitive silver halide emulsion layer, and at least one cyan-color-forming red-sensitive silver halide emulsion layer. The yellow-color-forming blue-sensitive silver halide emulsion layer functions as a yellow-color-forming layer containing a yellow-dye-forming coupler, the magenta-color-forming green-sensitive silver halide emulsion layer functions as a magenta-color-forming layer containing a magenta-dye-forming coupler, and the cyan-color-forming red-sensitive silver halide emulsion layer functions as a cyan-color-forming layer containing a cyan-dye-forming coupler. Preferably, the silver halide emulsions contained in the yellow-color-forming layer, the magenta-color-forming layer, and the cyan-color-forming layer may have photo-sensitivities to mutually different wavelength regions of light (for example, light in a blue region, light in a green region, and light in a red region).

In the light-sensitive material of the present invention, any of conventionally-known photographic materials or additives may be used.

For example, as a photographic support (base), a transmissive type support or a reflective type support may be used. As the transmissive type support, it is preferred to use a transparent support, such as a cellulose nitrate film, and a transparent film of polyethylene terephthalate; or a polyester of 2,6-naphthalenedicarboxylic acid (NDCA) and ethylene glycol (EG), a polyester of NDCA, terephthalic acid and EG, or the like, provided thereon with an information-recording layer such as a magnetic layer. In the present invention, it is preferred to use the reflective type support (or reflective support). As the reflective type support, it is especially preferable to use a reflective support having a substrate laminated thereon with a plurality of polyethylene layers or polyester layers, in which at least one of the water-proof resin layers (laminate layers) contains a white pigment such as titanium oxide.

In the present invention, a more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and the photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and the photographic constituting layers is preferably in the range of 10 to 100 μm, further preferably in the range of 15 to 70 μm. Further, the ratio of thickness of the polyolefin layer(s) to the paper substrate is preferably in the range of 0.05 to 0.2, further preferably in the range 0.1 to 0.15.

Further, it is also preferable, for enhancing rigidity of the reflective support, to provide a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml.

As to the reflective support that can be used in the present invention, preferable embodiments of the polyolefin layer provided on the paper substrate include those described in JP-A-10-333277, JP-A-10-333278, JP-A-11-52513, JP-A-11-65024, and European Patent Nos. 0880065 and 0880066.

Further, it is preferred that the above-described water-proof resin layer contains a fluorescent whitening agent. Further, the fluorescent whitening agent may be dispersed and contained in a hydrophilic colloid layer, which is formed separately from the above layers in the light-sensitive material. Preferred examples of the fluorescent whitening agent include benzoxazole-series, coumarin-series, and pyrazoline-series compounds. Further, fluorescent whitening agents of benzoxazolylnaphthalene-series and benzoxazolylstilbene-series are more preferably used. The amount of the fluorescent whitening agent to be used is not particularly limited, and preferably in the range of 1 to 100 mg/m$^2$. When the fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer-coating side or the reverse side of the support. In particular, it is preferable that the transmission density of the support is adjusted to the range of 0.35 to 0.8 so that a display may be enjoyed by means of both transmitted and reflected rays of light.

In the light-sensitive material of the present invention, in order to improve, e.g., sharpness of an image, a dye (particularly an oxonole-series dye) that can be discolored by processing, as described in European Patent No. 0337490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohols (e.g., trimethylolethane) to the water-proof resin layer of the support.

The light-sensitive material of the present invention preferably contains, in the hydrophilic colloid layer, a dye (particularly oxonole dyes and cyanine dyes) that can be discolored by processing, as described in European Patent Application Publication No. 0337490A2, pages 27 to 76, in order to prevent irradiation or halation or enhance safelight safety, and the like. Further, a dye described in European Patent Publication No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with the emulsion layer directly, or indirectly through an interlayer containing an agent for preventing color-mixing during processing, such as hydroquinone or gelatin. The colored layer is preferably provided as a lower layer (closer to a support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a conventionally-known method. For example, there are a method in which a dye in a state of a dispersion of solid fine particles is incorporated in a hydrophilic colloid layer, as described in JP-A-2-282244, from page 3, upper right column to page 8, and JP-A-3-793 1, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine-powder of a dye which is at least substantially water-insoluble at the pH of 6 or less, but at least substantially water-soluble at the pH of 8 or more, is incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine-powder of a dye, and of using colloidal silver.

The light-sensitive material of the present invention can be used for color negative films, color positive films, color reversal films, color reversal printing papers, color printing papers, display photosensitive materials, digital color proof photosensitive materials, motion-picture color positives, motion-picture color negatives, and the like; and among these, display photosensitive materials, digital color proof photosensitive materials, motion-picture color positives, color reversal printing papers, color printing papers, are preferable, and color printing papers are particularly preferable. It is preferable, as described above, that the color printing papers have at least one yellow-color-forming blue-sensitive silver halide emulsion layer, at least one magenta-color-forming green-sensitive silver halide emulsion layer and at least one cyan-color-forming red-sensitive silver halide emulsion layer. In general, the arranging order of these silver halide emulsion layers, from nearest the support to farthest from the support, is a yellow-color-forming blue-sensitive silver halide emulsion layer, a magenta-color-forming green-sensitive silver halide emulsion layer and a cyan-color-forming red-sensitive silver halide emulsion layer.

However, other layer arrangements which are different from the above, may be adopted.

In the present invention, the blue-sensitive silver halide emulsion layer may be provided at any position on a support. However, in the case where silver halide tabular grains are contained in the blue-sensitive silver halide emulsion layer, it is preferable that the blue-sensitive silver halide emulsion layer be positioned more apart from a support than at least one of the green-sensitive silver halide emulsion layer and the red-sensitive silver halide emulsion layer. Further, it is preferable that the blue-sensitive silver halide emulsion layer be positioned most apart from a support than other silver halide emulsion layers, from the viewpoint of color-development acceleration, desilvering acceleration, and reducing residual color due to a sensitizing dye. Further, it is preferable that the red-sensitive silver halide emulsion layer be disposed in the middle of the other silver halide emulsion layers, from the viewpoint of reducing blix fading. On the other hand, it is preferable that the red-sensitive silver halide emulsion layer be the lowest layer, from the viewpoint of reducing light fading. Further, each of the yellow-color-forming layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

Examples of silver halide emulsions that can be additionally used in combination with the silver halide emulsion defined in the present invention, other materials (additives or the like) and photographic constitutional layers (arrangement of the layers or the like) applicable to the present invention, and processing methods for processing the photographic materials and additives for processing, include those disclosed in JP-A-62-215272, JP-A-2-33144, and European Patent Application Publication No. 0,355,660A2. In particular, those disclosed in European Patent Application Publication No. 0,355,660A2 can be preferably used. Further, it is also preferred to use silver halide color photographic light-sensitive materials and processing methods thereof described, for example, in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Application Publication No. 0520457A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and anti-fading agents), the dyes (coloring layers), the kinds of gelatin, the layer constitution of the light-sensitive material, and the film pH of the light-sensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercapto-heterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and Column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer constitution of light-sensitive materials | Column 39, lines 11 to 26 | Column 44, lines 2 to 35 | Column 31, line 38 to Column 32, line 33 |
| Coating film pH of light-sensitive materials | Column 72, lines 12 to 28 | | |

TABLE 1-continued

| Element | JP-A-7-104448 | JP-A-7-77775 | JP-A-7-301895 |
|---|---|---|---|
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

As cyan, magenta, and yellow couplers which can be used in the photosensitive material in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, and page 47, line 23 to page 63, line 50, are also advantageously used.

Further, it is preferred for the present invention to add compounds represented by formula (II) or (III) in WO 98/33760 or compounds represented by formula (D) described in JP-A-10-221825.

As the cyan dye-forming coupler (hereinafter also simply referred to as "cyan coupler") which can be used in the present invention, pyrrolotriazole-series couplers are preferably used, and more specifically, couplers represented by formula (I) or (II) in JP-A-5-313324, couplers represented by formula (I) in JP-A-6-347960, and exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873, 183 and 4,916,051, and pyrazoloazole-type cyan couplers having a carbamoyl group at the 6-position, as described in JP-A-8-171185, JP-A-8-311360, and JP-A-8-339060.

In addition, as the cyan coupler, use can also be made of a diphenylimidazole-series cyan couplers described in JP-A-2-33 144; as well as 3-hydroxypyridine-series cyan couplers described in European patent 0333185 A2 (among these, a 2-equivalent coupler formed by allowing a 4-equivalent coupler of a coupler (42), to have a chlorine splitting-off group, and couplers (6) and (9), enumerated as specific examples are particularly preferable); cyclic active methylene-series cyan couplers described in JP-A-64-32260 (among these, couplers 3, 8, and 34 enumerated as specific examples are particularly preferable); pyrrolopyrazole-type cyan couplers described in European Patent No. 0456226 A1; and pyrroloimidazole-type cyan couplers described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference as a part of the present specification.

The magenta dye-forming couplers (which may be referred to simply as a "magenta coupler" hereinafter) that can be used in the present invention can be 5-pyrazolone-series magenta couplers and pyrazoloazole-series magenta couplers, such as those described in the known publications in the above table. Among these, preferred are pyrazolotriazole couplers in which a secondary or tertiary alkyl group is directly bonded to the 2-, 3-, or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference as a part of the present specification. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" herein), preferably use can be made, of acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; acylacetamide-type yellow couplers having a dioxane structure, such as those described in U.S. Pat. No. 5,118,599; and acetanilide-type yellow couplers whose acyl groups have heterocyclic groups as their respective substituents, such as those described in JP-A-2003-173007, in addition to the compounds described in the above-mentioned table. Of these couplers, the acylacetamide-type yellow couplers whose acyl groups are 1-alkylcyclopropane-1-carbonyl groups, the malondianilide-type yellow couplers wherein either anilide forms an indoline ring, or the acetanilide-type yellow couplers whose acyl groups have heterocyclic groups as their respective substituents, can be preferably used. These couplers may be used singly or in combination.

It is preferred that couplers for use in the present invention, are impregnated with a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homo-polymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers, are more preferable, in view of color-image stabilization and the like.

In the present invention, known color mixing-inhibitors may be used. Among these compounds, those described in the following patent publications are preferred.

For example, high-molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No. 19629142 A1 and the like, may be used. In particular, in order to accelerate developing speed by increasing the pH of a developing solution, redox compounds described in German Patent Application Publication No. 19618786A1, European Patent Application Publication Nos. 839623A1 and 842975A1, German Patent Application Publication No. 19806846A1, French Patent Application Publication No. 2760460A1, and the like, are also preferably used.

In the present invention, as an ultraviolet ray absorbent, it is preferred to use a compound having a triazine skeleton high in a molar extinction coefficient. For example, those described in the following patent publications can be used. These compounds can be preferably used in the light-sensitive layer or/and the light-insensitive layer. For example, use can be made of the compound described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804A, JP-T-8-501291 ("JP-T" means published searched patent publication), and the like.

As a binding agent or a protective colloid which can be used in the photosensitive material of the present invention, a gelatin is used advantageously. Hydrophilic colloid other than the gelatin may be used singly or in combination with the gelatin. It is preferable for the gelatin that the content of heavy metals, such as Fe, Cu, Zn and Mn, included as impurities, be reduced to 5 ppm or below, further preferably 3 ppm or below. Further, the amount of calcium contained in the light-sensitive material is preferably 20 mg/m$^2$ or less, further preferably 10 mg/m$^2$ or less, and most preferably 5 mg/m$^2$ or less.

In the present invention, it is preferred to add an antibacterial (fungi-preventing) agent or antimold agent, as described in JP-A-63-271247, to the light-sensitive material, in order to destroy various kinds of molds and bacteria which propagate in a hydrophilic colloid layer and deteriorate the image. Further, the pH of the coating film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount, of the light-sensitive material. As the surface-active agent, there are anionic, cationic, betaine or nonionic surfactants. Examples thereof include those described in JP-A-5-333492. As the surface-active agent for use in the present invention, a fluorine-containing surface-active agent is preferred. In particular, a fluorine-containing surface-active agent is preferably used. The fluorine-containing surface-active agent may be used singly or in combination with conventionally-known another surface-active agent. The fluorine-containing surfactant is preferably used in combination with conventionally-known another surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive materials of the present invention can form images, as shown in the example of an image-forming equipment used for performing exposure processing of photosensitive materials, by undergoing an exposure process of irradiating the photosensitive materials with light responsive to image information and a development process of developing the exposed photosensitive materials.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources be a semiconductor laser.

It is preferred that the light-sensitive material of the present invention is imagewise exposed to coherent light from a blue laser having an emission wavelength of 420 nm to 460 nm. Among the blue lasers, it is particularly preferable to use a blue semiconductor laser.

Specific examples of the laser source include a blue semiconductor laser having a wavelength of 430 to 450 nm (presented by Nichia Corporation at the 48th Meeting of the Japan Society of Applied Physics and Related Societies in March in 2001), a blue laser having a wavelength of about 470 nm obtained by wavelength modulation of a semiconductor laser (oscillation wavelength: about 940 nm) with a SHG crystal of $LiNbO_3$ having a reversed domain structure in the form of a wave guide, a green laser having a wavelength of about 530 nm obtained by wavelength modulation of a semiconductor laser (oscillation wavelength: about 1,060 nm) with a SHG crystal of $LiNbO_3$ having a reversed domain structure in the form of a wave guide, a red semiconductor laser having a wavelength of about 685 nm (Type No. HL6738MG (trade name), manufactured by Hitachi, Ltd.), a red semiconductor laser having a wavelength of about 650 nm (Type No. HL6501MG (trade name), manufactured by Hitachi, Ltd.), and the like.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. The exposure time in such a scanning exposure is defined as the time necessary to expose the size of the picture element with the density of the picture element being 300 dpi, and preferred exposure time is $1\times10^{-4}$ sec or less, and further preferably $1\times10^{-6}$ sec or less.

The silver halide color photographic light-sensitive material according to the present invention can be preferably used in combination with the exposure and development systems described in the following know publications. Examples of the development systems include the automatic printing and the developing system disclosed in JP-A-10-333253, the transporting apparatus of a light-sensitive material disclosed in JP-A-2000-10206, the recording system including an image reader disclosed in JP-A-11-215312, the exposure systems comprising a color image-recording system disclosed in JP-A-11-88619 and JP-A-10-202950, the digital photo print system including a remote diagnostic system disclosed in JP-A-10-210206, and the photo print system including an image-recording apparatus disclosed in JP-A-2000-310822.

The preferred scanning exposure methods which can be applied to the present invention are described in detail in the patent publications listed in the above described table.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied. Further, as the preservative for use in the developing solution, compounds described in the patent publications listed in the above described table can be used.

The light-sensitive material of the present invention can be preferably used as a light-sensitive material having rapid processing suitability. In the case of conducting rapid processing, the color-developing time is preferably 30 sec or less, more preferably from 25 sec to 6 sec, and further preferably from 20 sec to 6 sec. Likewise, the blix time is preferably 30 sec or less, more preferably from 25 sec to 6 sec, and further preferably from 20 sec to 6 sec. Further, the washing or stabilizing time is preferably 60 sec or less, and more preferably from 40 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when a processing is carried out using an autoprocessor or the like, the color-developing time is the sum total of a time in which a light-sensitive material has been dipped in a color developing solution (so-called "time in the solution") and a time in which the light-sensitive material has left the color-developing solution and been conveyed in air toward a bleach-fixing bath in the subsequent processing step (so-called "time in the air"). Likewise, the term "blix time" as used herein means a period of time required from the beginning of dipping a light-sensitive material into a bleach-fix bath until the light-sensitive material is dipped into a washing or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying process (so-called "time in the solution").

In the present invention, the color-developing time suitable for the light-sensitive materials of the present invention is 20 seconds or below (preferably 6 to 20 seconds, far preferably 6 to 15 seconds). The expression "color-development carried out under a color-developing time of 20 seconds or below" means that the color-developing time, not the total time required for conducting the whole processing steps of the color-development processing, is 20 seconds or below.

The present invention will be described in more detail based on the following examples, but the invention is not intended to be limited thereto.

EXAMPLES

Example 1

(Preparation of Blue-sensitive Layer Emulsion BH-1)

Using a method of simultaneously adding silver nitrate and sodium chloride mixed into stirring deionized distilled water containing deionized gelatin, high silver chloride cubic grains were prepared. In the course of this preparation, $Cs_2[OsCl_5(NO)]$ was added, over the step of from 60% to 80% addition of the entire silver nitrate amount. Over the step of from 80% to 90% addition of the entire silver nitrate amount, potassium bromide (1.5 mol % per mol of the finished silver halide) and $K_4[Fe(CN)_6]$ were added. Over the step of from 83% to 88% addition of the entire silver nitrate amount, $K_2[IrCl_6]$ was added. Over the step of from 92% to 98% addition of the entire silver nitrate amount, $K_2[IrCl_5(H_2O)]$ and $K[IrCl_4(H_2O)_2]$ were added. At the completion of 94% addition of the entire silver nitrate amount, potassium iodide (0.27 mol % per mol of the finished silver halide) was added under vigorous stirring. The thus-obtained emulsion grains were monodisperse cubic silver iodobromochloride grains having a side length of 0.54 μm and a variation coefficient of 8.5%. After flocculation desalting treatment, gelatin, Compounds Ab-1, Ab-2, and Ab-3 each set forth below, and calcium nitrate were added to the resulting emulsion for re-dispersion.

The re-dispersed emulsion was dissolved at 40° C., and thereto, Sensitizing dye S-1, Sensitizing dye S-2, and Sensitizing dye S-3 were added for optimal spectral sensitization. Then, the resulting emulsion was ripened by adding sodium benzene thiosulfate, triethylthiourea as a sulfur sensitizer, and Compound-1 as a gold sensitizer, for optimal chemical sensitization. Further, 1-(5-methylureidophenyl)-5-mercaptotetrazole; Compound-2; a mixture whose major components were compounds represented by Compound-3 in which the repeating unit (n) was 2 or 3 (both ends $X_1$ and $X_2$ were each a hydroxyl group); Compound-4, and potassium bromide were added, to finalize chemical sensitization. The thus-obtained emulsion was referred to as Emulsion BH-1.

(Ab-1) Antiseptic

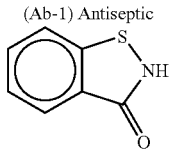

(Ab-2) Antiseptic

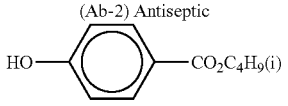

(Ab-3) Antiseptic

-continued

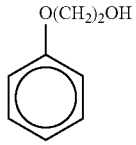

(Ab-4) Antiseptic

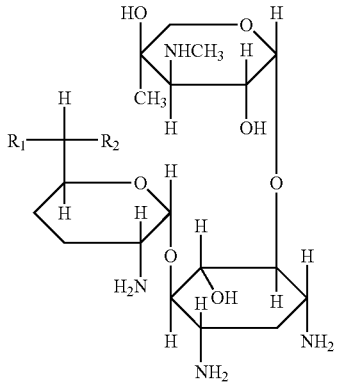

A mixture in 1:1:1:1 (mol ratio) of a, b, c, d

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Sensitizing dye S-1

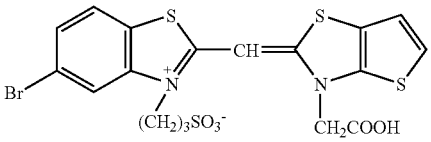

Sensitizing dye S-2

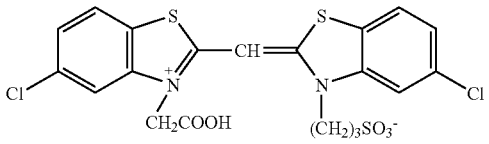

Sensitizing dye S-3

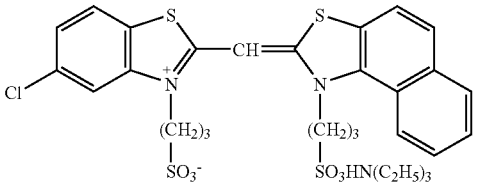

Compound-1

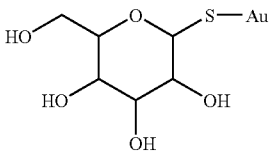

-continued

Compound-2

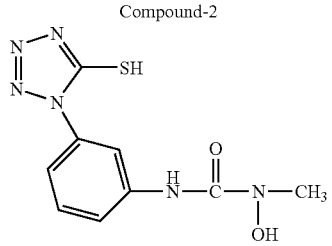

Compound-3

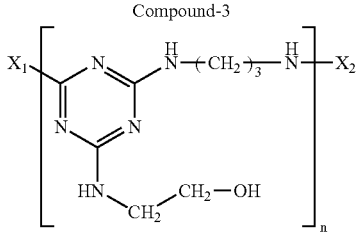

Compound-4

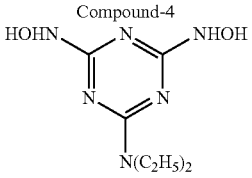

(Preparation of Blue-sensitive Layer Emulsion BL-1)

Emulsion grains were prepared in the same manner as in the preparation of Emulsion BH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-1 was prepared in the same manner as Emulsion BH-1, except that the amounts of various compounds to be added in the preparation of Emulsion BH-1 were changed.

(Preparation of Green-sensitive Layer Emulsion GH-1)

Using a method of simultaneously adding silver nitrate and sodium chloride mixed into stirring deionized distilled water containing deionized gelatin, high silver chloride cubic grains were prepared. In the course of this preparation, $K_4[Ru(CN)_6]$ was added over the step of from 80% to 90% addition of the entire silver nitrate amount. Over the step of from 80% to 100% addition of the entire silver nitrate amount, potassium bromide (2 mol % per mol of the finished silver halide) was added. Over the step of from 83% to 88% addition of the entire silver nitrate amount, $K_2[IrCl_6]$ and $K_2[RhBr_5(H_2O)]$ were added. At the completion of 90% addition of the entire silver nitrate amount, potassium iodide (0.1 mol % per mol of the finished silver halide) was added under vigorous stirring. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a side length of 0.42 μm and a variation coefficient of 8.0%. The resulting emulsion was subjected to flocculation desalting treatment and re-dispersing treatment in the same manner as described in the above.

This emulsion was dissolved at 40° C., and thereto, sodium benzenethiosulfate, p-glutaramidophenyldisulfide, sodium thiosulfate pentahydrate as a sulfur sensitizer, and (bis(1,4,5-trimethyl-1,2,4-triazolium-3-thiorato)aurate (I) tetrafluoroborate) as a gold sensitizer were added, and the emulsion was subjected to ripening for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. Further, in a midway of the emulsion preparation process, Sensitizing dyes S-4, S-5, S-6 and S-7 were added as sensitizing dyes, to conduct spectral sensitization. The thus-obtained emulsion was referred to as Emulsion GH-1.

Sensitizing dye S-4

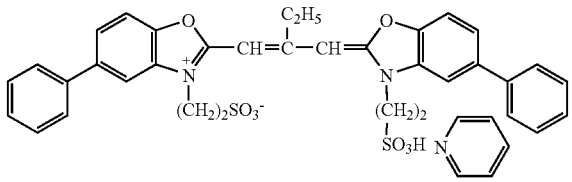

Sensitizing dye S-5

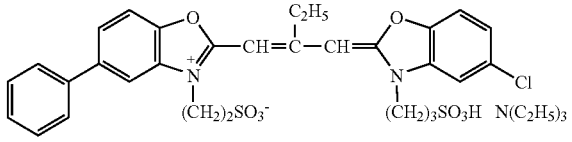

Sensitizing dye S-6

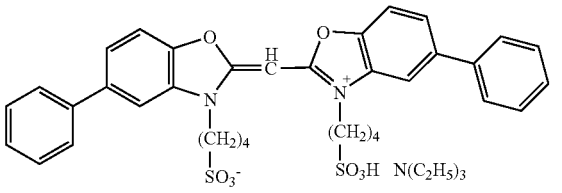

Sensitizing dye S-7

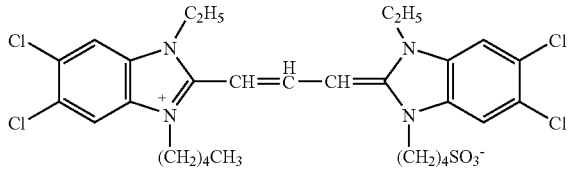

(Preparation of Green-sensitive Layer Emulsion GL-1)

Emulsion grains were prepared in the same manner as in the preparation of Emulsion GH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.35 μm and a variation coefficient of 9.8%. After re-dispersion of this emulsion, Emulsion GL-1 was prepared in the same manner as Emulsion GH-1, except that the amounts of various compounds to be added in the preparation of Emulsion GH-1 were changed.

(Preparation of Red-sensitive Layer Emulsion RH-1)

Using a method of simultaneously adding silver nitrate and sodium chloride mixed into stirring deionized distilled water containing deionized gelatin, high silver chloride cubic grains were prepared. In the course of this preparation, $Cs_2[OsCl_5(NO)]$ was added over the step of from 60% to 80% addition of the entire silver nitrate amount. Over the step of from 80% to 90% addition of the entire silver nitrate amount, $K_4[Ru(CN)_6]$ was added. Over the step of from 80% to 100% addition of the entire silver nitrate amount, potassium bromide (1.3 mol % per mol of the finished silver halide) was added. Over the step of from 83% to 88% addition of the entire silver nitrate amount, $K_2[IrCl_5(5\text{-methylthiazole})]$ was added. Further, over the step of from 92% to 98% addition of the entire silver nitrate amount, $K_2[IrCl_5(H_2O)]$ and $K[IrCl_4(H_2O)_2]$ were added. The thus-obtained emulsion grains were monodisperse cubic silver iodobromochloride grains having a cubic side length of 0.39 μm and a variation coefficient of 10%. The resulting emulsion was subjected to flocculation desalting treatment and re-dispersing treatment in the same manner as described in the above.

This emulsion was dissolved at 40° C., and thereto, Sensitizing dye S-8, Compound-5, triethylthiourea as a sulfur sensitizer, and the above-described Compound-1 as a gold sensitizer were added, and the resulting emulsion was ripened for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

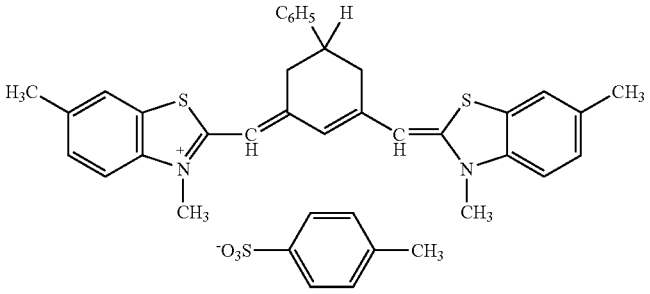

-continued

Compound-5

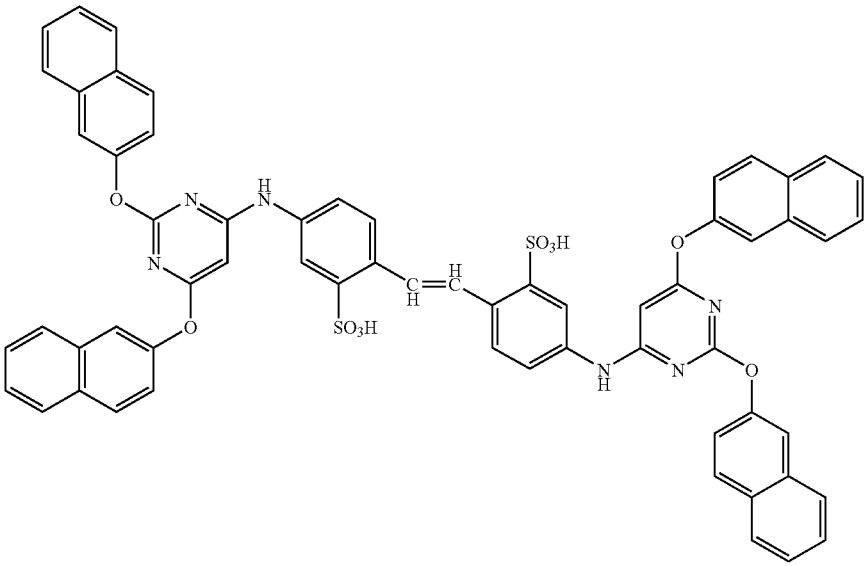

(H-1) Hardener

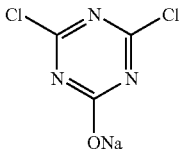

(H-2) Hardener

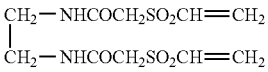

(H-3) Hardener

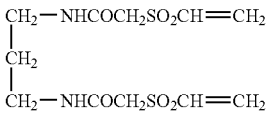

(Preparation of Red-sensitive Layer Emulsion RL-1)

Emulsion grains were prepared in the same manner as in the preparation of Emulsion RH-1, except that the temperature and the addition speed at the step of mixing silver nitrate and sodium chloride by simultaneous addition were changed, and that the amounts of respective metal complexes that were to be added in the course of the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to flocculation desalting treatment and re-dispersion, Emulsion RL-1 was prepared in the same manner as Emulsion RH-1, except that the amounts of various compounds to be added in the preparation of Emulsion RH-1 were changed.

Emulsions RH-2 to RH-30 and emulsions RL-2 to RL-30 were prepared in the same manner as in the preparation of the emulsions RH-1 and RL-1, respectively, except that the amounts of silver iodide, the kind of the desensitizing gradation-hardening metal dopant and the kind of the red-sensitizing dye were changed as shown in Table 2. In this connection, at the completion of 88% addition of the entire silver nitrate amount, potassium iodide (in such a silver iodide amount per mol of the finished silver halide) was added under vigorous stirring, to introduce silver iodide. The desensitizing gradation-hardening dopant and the red-sensitizing dye were, respectively, added in an optimum amount.

TABLE 2

| Emulsion | Silver iodide amount (mol %) | Kind and addition amount (mol/molAg) of desensitizing gradation-hardening dopant | Red-sensitizing dye |
|---|---|---|---|
| RH-1/RL-1 | 0 | $Cs_2[OsCl_5(NO)]$ ($3 \times 10^{-9}$) | S-8 |
| RH-2/RL-2 | 0.04 | " | " |
| RH-3/RL-3 | 0.06 | " | " |
| RH-4/RL-4 | 0.08 | " | " |
| RH-5/RL-5 | 0.1 | " | " |
| RH-6/RL-6 | 0.2 | " | " |
| RH-7/RL-7 | 0 | " | S-9 |
| RH-8/RL-8 | 0.04 | " | " |
| RH-9/RL-9 | 0.06 | " | " |
| RH-10/RL-10 | 0.08 | " | " |
| RH-11/RL-11 | 0.1 | " | " |
| RH-12/RL-12 | 0 | — | S-8 |
| RH-13/RL-13 | 0.04 | " | " |
| RH-14/RL-14 | 0.06 | " | " |
| RH-15/RL-15 | 0.08 | " | " |
| RH-16/RL-16 | 0 | $Cs_2[OsCl_5(NO)]$ ($6 \times 10^{-9}$) | " |
| RH-17/RL-17 | 0.04 | " | " |
| RH-18/RL-18 | 0.06 | " | " |
| RH-19/RL-19 | 0.08 | " | " |
| RH-20/RL-20 | 0 | " | S-9 |
| RH-21/RL-21 | 0.04 | " | " |
| RH-22/RL-22 | 0.06 | " | " |
| RH-23/RL-23 | 0.08 | " | " |
| RH-241RL-24 | 0 | $K_2[RuCl_5(NO)]$ ($6 \times 10^{-9}$) | " |
| RH-25/RL-25 | 0.04 | " | " |
| RH-26/RL-26 | 0.06 | " | " |
| RH-27/RL-27 | 0.08 | " | " |

TABLE 2-continued

| Emulsion | Silver iodide amount (mol %) | Kind and addition amount (mol/molAg) of desensitizing gradation-hardening dopant | Red-sensitizing dye |
|---|---|---|---|
| RH-28/RL-28 | 0.04 | $K_2[RhBr_5(H_2O)]$ ($6 \times 10^{-9}$) | S-8 |
| RH-29/RL-29 | 0.06 | " | " |
| RH-30/RL-30 | 0.08 | " | " |

Sensitizing dye S-9

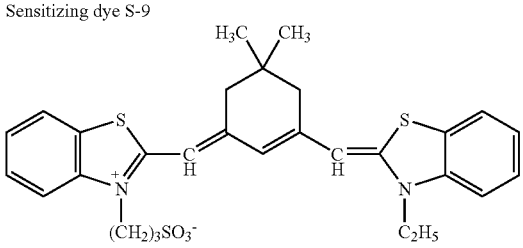

(Preparation of a Coating Solution for the First Layer)

Into 23 g of a solvent (Solv-4), 4 g of a solvent (Solv-6), 23 g of a solvent (Solv-9) and 60 ml of ethyl acetate, were dissolved 34 g of a yellow coupler (Ex-Y), 1 g of a color-image stabilizer (Cpd-1), 1 g of a color-image stabilizer (Cpd-2), 8 g of a color-image stabilizer (Cpd-8), 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-A). This solution was emulsified and dispersed in 270 g of a 20 mass % aqueous gelatin solution containing 4 g of sodium dodecylbenzenesulfonate, with a high-speed stirring emulsifier (dissolver). Then, water was added thereto, to prepare 900 g of Emulsified Dispersion A.

Separately, the above-described Emulsified Dispersion A, and the above-described Emulsions BH-1 and BL-1 were mixed and dissolved, to prepare a coating solution for the first layer having the composition shown below. The coating amounts of the emulsions are in terms of silver.

The coating solutions for the second to seventh layers were prepared in the similar manner as in the coating solution for the first layer. As a gelatin hardener for each layer, (H-1), (H-2), and (H-3) were used. Further, (Ab-1), (Ab-2), (Ab-3), and (Ab-4) were added to each layer, so that their total amounts would be 14.0 mg/m$^2$, 62.0 mg/m$^2$, 5.0 mg/m$^2$, and 10.0 mg/m$^2$, respectively.

Further, 1-(3-methylureidophenyl)-5-mercaptotetrazole was added to the second layer, the fourth layer, and the sixth layer, in amounts of 0.2 mg/m$^2$, 0.2 mg/m$^2$, and 0.6 mg/m$^2$, respectively. Further, 4-hydroxy-6-methyl-1,3,3a,7-tetrazaindene was added to the blue-sensitive emulsion layer and the green-sensitive emulsion layer, in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight of from 200,000 to 400,000) in an amount of 0.05 g/m$^2$. Further, disodium catecol-3,5-disulfonate was added to the second layer, the fourth layer, and the sixth layer, so that respective amounts would be 6 mg/m$^2$, 6 mg/m$^2$, and 18 mg/m$^2$. Further, to each layer, sodium polystyrenesulfonate was optionally added to adjust viscosity of the coating solutions. Further, in order to prevent irradiation, the following dyes (coating amounts are shown in parentheses) were added.

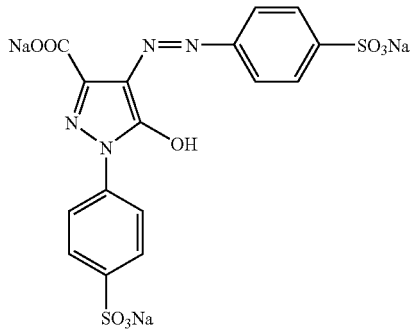

(2 mg/m$^2$)

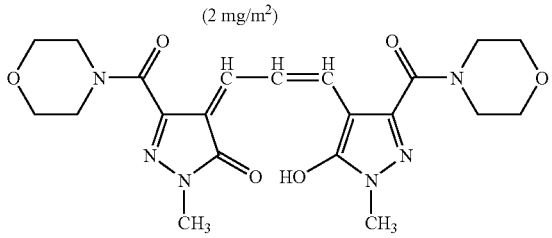

(3 mg/m$^2$)

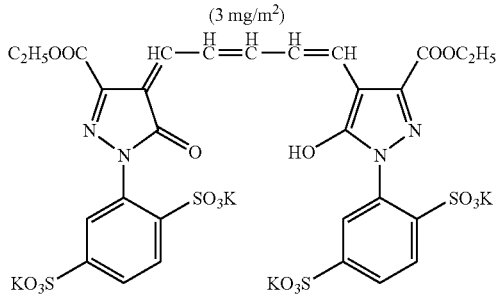

(10 mg/m$^2$)

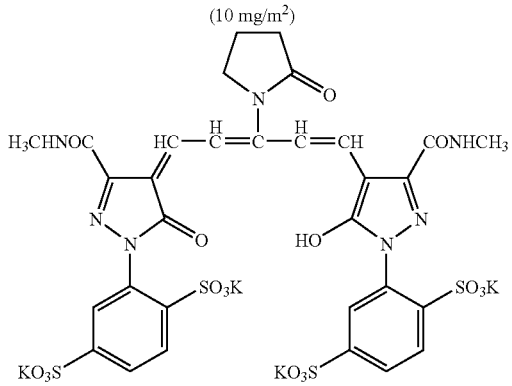

(16 mg/m$^2$)

(Layer Constitution)

The composition of each layer is shown below. The numbers show coating amounts (g/m$^2$). In the case of the silver halide emulsion, the coating amount is in terms of silver.

Support

Polyethylene-resin-laminated Paper

{The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %), and a bluish dye (ultramarine, content of 0.33 mass %); and the amount of the polyethylene resin was 29.2 g/m$^2$.}

First Layer (Blue-sensitive Emulsion Layer)

| First layer (Blue-sensitive emulsion layer) | |
|---|---|
| Emulsion (a 5:5 mixture of BH-1 and BL-1 (mol ratio of silver)) | 0.16 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Color-image stabilizer (Cpd-23) | 0.15 |
| Additive (ExC-1) | 0.001 |
| Color-image stabilizer (UV-A) | 0.01 |
| Solvent (Solv-4) | 0.23 |
| Solvent (Solv-6) | 0.04 |
| Solvent (Solv-9) | 0.23 |

| Second layer (Color-mixing-inhibiting layer) | |
|---|---|
| Gelatin | 0.78 |
| Color-mixing inhibitor (Cpd-4) | 0.05 |
| Color-mixing inhibitor (Cpd-12) | 0.01 |
| Color-image stabilizer (Cpd-5) | 0.006 |
| Color-image stabilizer (Cpd-6) | 0.05 |
| Color-image stabilizer (UV-A) | 0.06 |
| Color-image stabilizer (Cpd-7) | 0.006 |
| Solvent (Solv-1) | 0.06 |
| Solvent (Solv-2) | 0.06 |
| Solvent (Solv-5) | 0.07 |
| Solvent (Solv-8) | 0.07 |

| Third layer (Green-sensitive emulsion layer) | |
|---|---|
| Emulsion (a 1:3 mixture of GH-1 and GL-1 (mol ratio of silver)) | 0.12 |
| Gelatin | 0.95 |
| Magenta coupler (Ex-M) | 0.12 |
| Ultraviolet absorber (UV-A) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |

| Fourth layer (Color-mixing-inhibiting layer) | |
|---|---|
| Gelatin | 0.65 |
| Color-mixing inhibitor (Cpd-4) | 0.04 |
| Color-mixing inhibitor (Cpd-12) | 0.01 |
| Color-image stabilizer (Cpd-5) | 0.005 |
| Color-image stabilizer (Cpd-6) | 0.04 |
| Color-image stabilizer (UV-A) | 0.05 |
| Color-image stabilizer (Cpd-7) | 0.005 |
| Solvent (Solv-1) | 0.05 |
| Solvent (Solv-2) | 0.05 |

-continued

| Fourth layer (Color-mixing-inhibiting layer) | |
|---|---|
| Solvent (Solv-5) | 0.06 |
| Solvent (Solv-8) | 0.06 |

| Fifth layer (Red-sensitive emulsion layer) | |
|---|---|
| Emulsion (a 4:6 mixture of RH-1 and RL-1 (mol ratio of silver)) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |

| Sixth layer (Ultraviolet-absorbing layer) | |
|---|---|
| Gelatin | 0.34 |
| Ultraviolet absorber (UV-B) | 0.24 |
| Compound (S1-4) | 0.0015 |
| Solvent (Solv-7) | 0.11 |

Seventh Layer (Protective Layer)

| Seventh layer (Protective layer) | |
|---|---|
| Gelatin | 0.82 |
| Additive (Cpd-22) | 0.03 |
| Liquid paraffin | 0.02 |
| Surfactant (Cpd-13) | 0.02 |

(Ex-Y) Yellow coupler

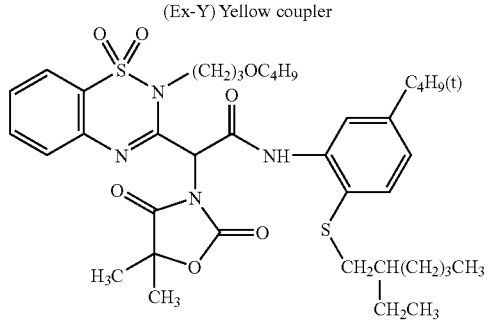

-continued
(Ex-M) Magenta coupler
A mixture in 40:40:20 (mol ratio) of
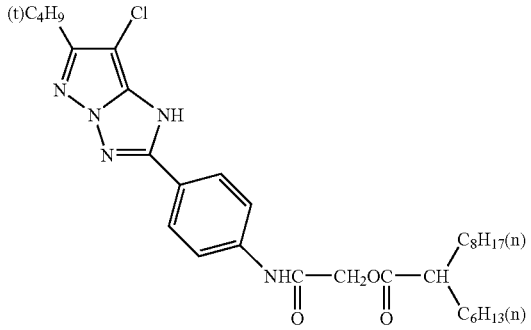
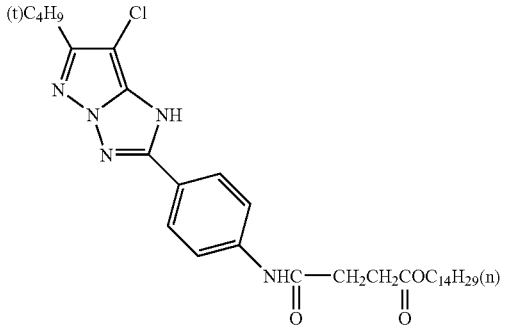
and
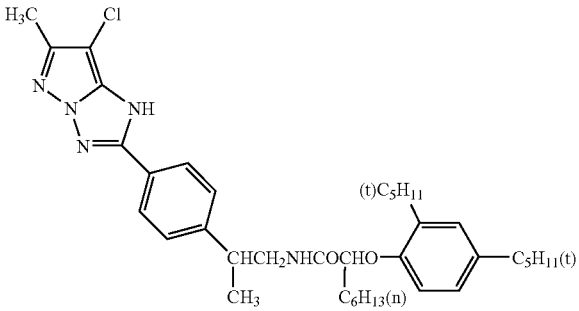
(ExC-1) Cyan coupler
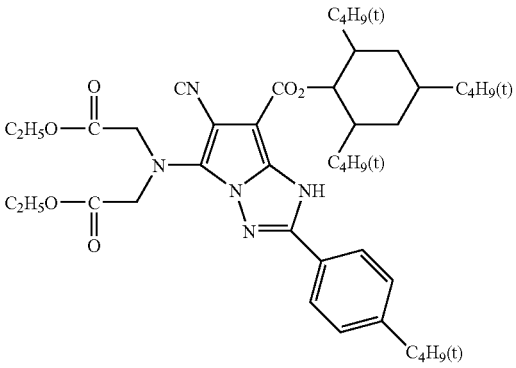
-continued
(ExC-2) Cyan coupler
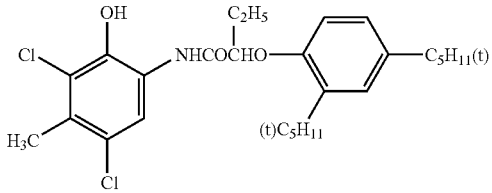
(ExC-3) Cyan coupler
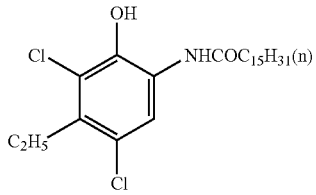
(Cpd-1) Color-image stabilizer
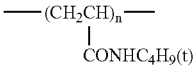
Number-average molecular weight 60.000
(Cpd-2) Color-image stabilizer
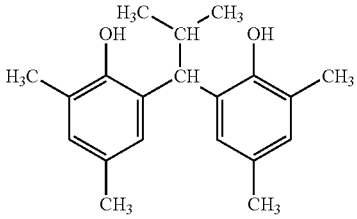
(Cpd-3) Color-image stabilizer
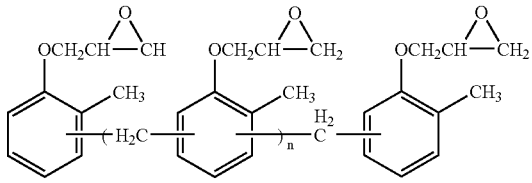
n = 7~8 (Average value)
(Cpd-4) Color-image stabilizer
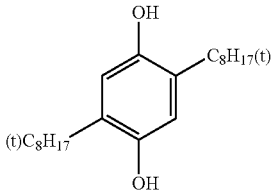
(Cpd-5) Color-image stabilizer
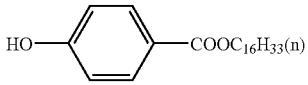

-continued
(Cpd-6) Color-image stabilizer
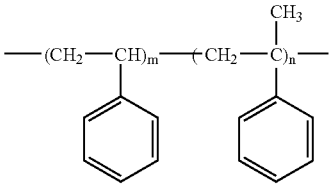
Number-average molecular weight 600, m/n = 10/9
(Cpd-7) Color-image stabilizer
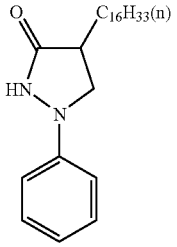
(Cpd-8) Color-image stabilizer
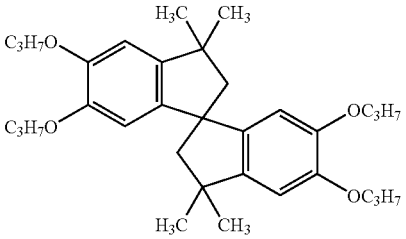
(Cpd-9) Color-image stabilizer
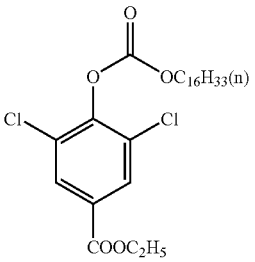
(Cpd-10) Color-image stabilizer
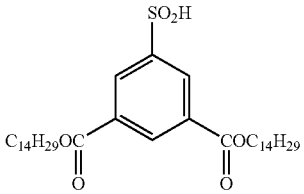
-continued
(Cpd-11)
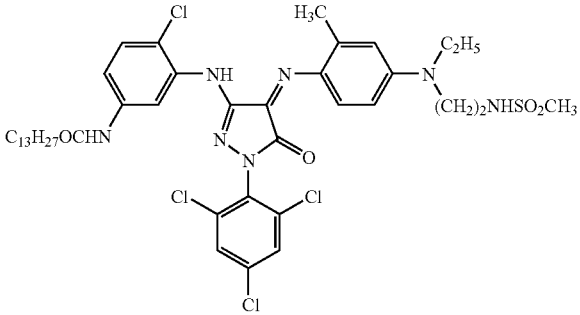
(Cpd-12)
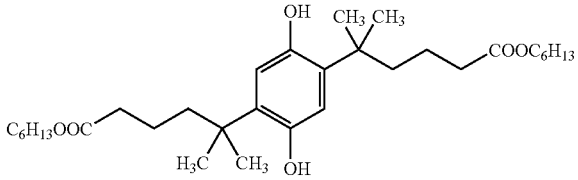
(Cpd 13)
A mixture in 6:2:2 (mol ratio) of (a)/(b)/(c)
(a)
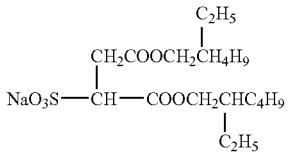
(b)
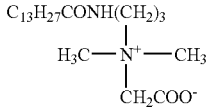
(c)
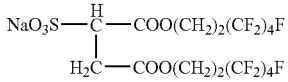
(Cpd-14)
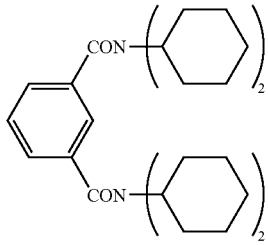
(Cpd-15)
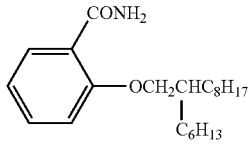

-continued
(Cpd-16)
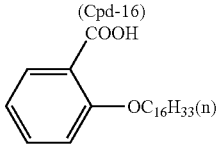
(Cpd-17)
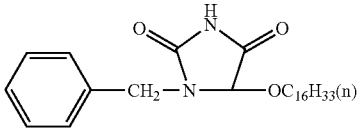
(Cpd-18)
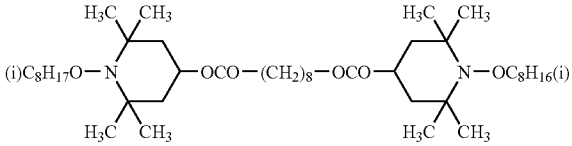
(Cpd-19)
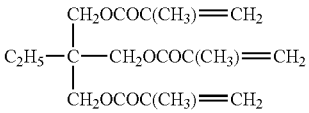
(Cpd-20)
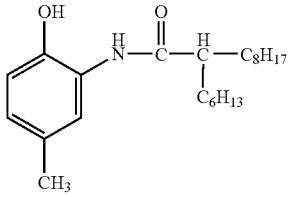
(Cpd-21)
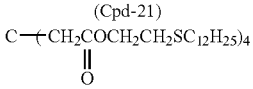
(Cpd-22)
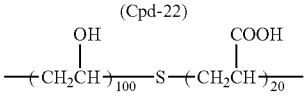
(Mass ratio)
(Cpd-23)
KAYARAD DPCA-30
(trade name, manufactured by Nippon Kayaku Co. Ltd.)
(Solv-1)
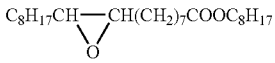
(Solv-2)
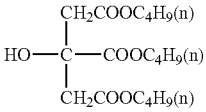
(Solv-3)
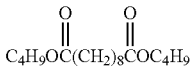
-continued
(Solv-4)
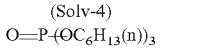
(Solv-5)
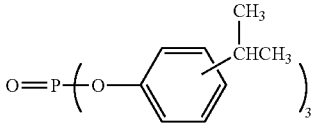
(Solv-6)
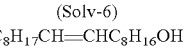
(Solv-7)
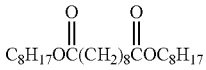
(Solv-8)
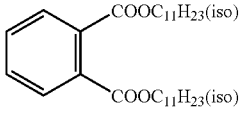
(Solv-9)
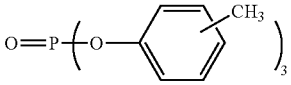
(S1-4)
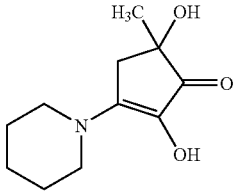
UV-A: A mixture of (UV-1)/(UV-4)/(UV-5) = 1/7/2 (mass ratio)
UV-B: A mixture of (UV-1)/(UV-2)/(UV-3)/(UV-4)/(UV-5) = 1/1/2/3/3 (mass ratio)
(UV-1)
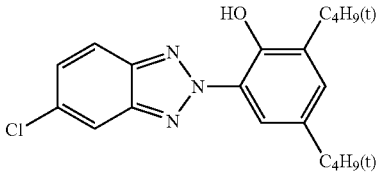
(UV-2)
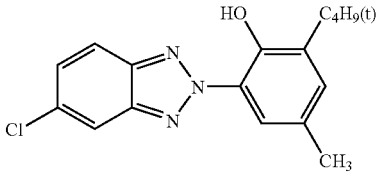
(UV-3)
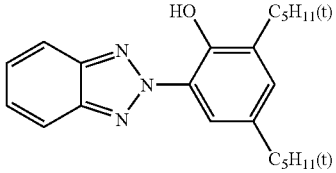

-continued (UV-4)

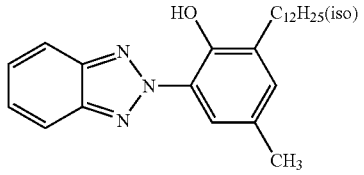

(UV-5)

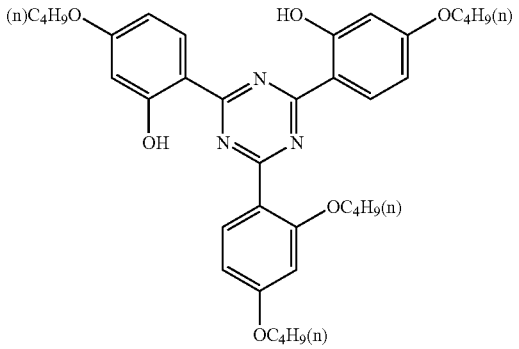

The sample prepared in the above manner was designated as a sample 101. A sample 102 was prepared in the same manner as in the preparation of the sample 101, except that the silver halide emulsions of the red-sensitive emulsion layer were changed to the emulsion RH-2/RL-2. Samples 103 to 130 were prepared in the same manner as above. In each example, the mol ratio of silver in the two kinds of emulsions in the layer was the same as that in the sample 101.

Processing A

The above samples 101 to 130 were respectively processed into a roll form 127 mm in width and exposed to light with a standard photographic image by using Digital Minilabo Frontier 350 (trade name, manufactured by Fuji Photo Film Co., Ltd.). Using the sample 101, continuous treatment (running test) was carried out using the following process steps until the volume of a color developing replenishing solution became twice the volume of a color-developing tank. The treatment using this running processing solution was designated as treatment A

| Processing step | Temperature | Time | Replenisher amount* |
|---|---|---|---|
| Color development | 38.5° C. | 45 sec | 45 mL |
| Bleach-fixing | 38.0° C. | 45 sec | 35 mL |
| Rinse (1)** | 38.0° C. | 20 sec | — |
| Rinse (2)** | 38.0° C. | 20 sec | — |
| Rinse (3)** | 38.0° C. | 20 sec | — |

-continued

| Processing step | Temperature | Time | Replenisher amount* |
|---|---|---|---|
| Rinse (4)** | 38.0° C. | 20 sec | 121 mL |
| Drying | 80° C. | | |

(Note)
*Replenishment rate per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from (1) to (4).

Processing solutions used in the process steps respectively had the following compositions:

| (Color developer) | (Tank solution) | (Replenisher) |
|---|---|---|
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl) aniline•3/2 sulfate•monohydrate | 4.8 g | 14.0 g |
| Potassium carbonate | 26.3 g | 26.3 g |
| Water to make | 1,000 ml | 1,000 ml |
| pH (25° C., adjusted using sulfuric acid and KOH) | 10.15 | 12.40 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| m-Carboxybenzenesulfinic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C., adjusted using nitric acid and aqueous ammonia) | 6.5 | 6.5 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

Processing B

Using the samples 101 to 130, continuous treatment (running test) was carried out using the following process steps until the volume of a color-developing replenishing solution became twice the volume of a color-developing tank. A processing with this running processing solutions was named processing B. Using this running processing solutions, each light-sensitive material was treated in the following process steps.

| Processing step | Temperature | Time | Replenisher amount* |
|---|---|---|---|
| Color development | 45.0° C. | 17 sec | 35 mL |
| Bleach-fixing | 40.0° C. | 17 sec | 30 mL |
| Rinse (1)** | 45.0° C. | 4 sec | — |
| Rinse (2)** | 45.0° C. | 4 sec | — |
| Rinse (3)** | 45.0° C. | 3 sec | — |
| Rinse (4)** | 45.0° C. | 5 sec | 121 mL |
| Drying | 80° C. | 15 sec | |

(Note)

*Replenishment rate per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from (1) to (4).

Processing solutions used in the process steps respectively had the following compositions:

| [Color developer] | [Tank solution] | [Replenisher] |
|---|---|---|
| Water | 800 mL | 800 mL |
| Fluorescent whitening agent (FL-3) | 4.0 g | 8.0 g |
| Residual-color-reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)-aniline•3/2 sulfate•monohydrate | 7.0 g | 19.0 g |
| Potassium carbonate | 26.3 g | 26.3 g |
| Water to make | 1,000 mL | 1,000 mL |
| pH (25° C., adjusted by using sulfuric acid and KOH) | 10.25 | 12.6 |

| [Bleach-fixing solution] | [Tank solution] | [Replenisher] |
|---|---|---|
| Water | 800 mL | 800 mL |
| Ammonium thiosulfate (750 g/L) | 107 mL | 214 mL |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 mL | 1,000 mL |
| pH (25° C., adjusted by using nitric acid and aqua ammonia) | 6.00 | 6.00 |

| [Rinse solution] | [Tank solution] | [Replenisher] |
|---|---|---|
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

FL-1

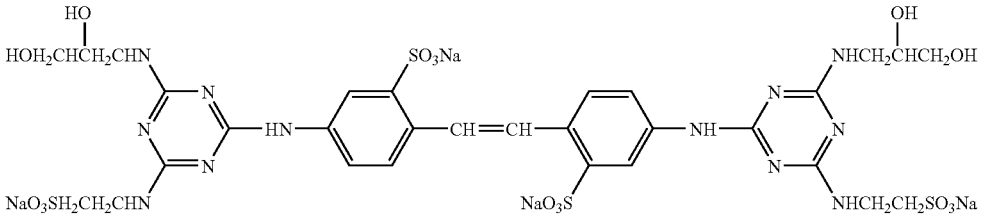

FL-2

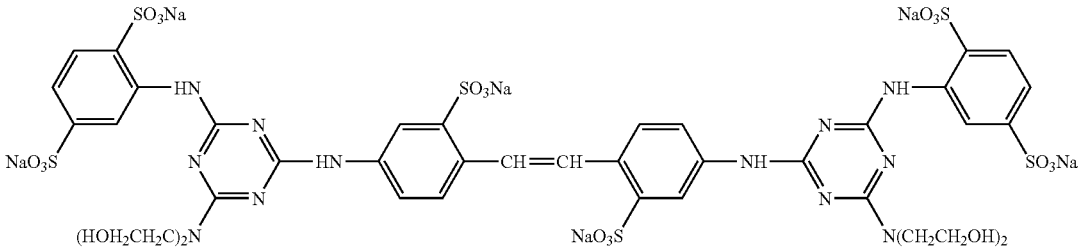

-continued

| [Rinse solution] | [Tank solution] | [Replenisher] |
|---|---|---|

FL-3

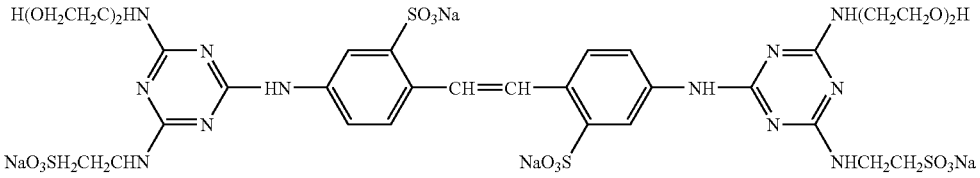

SR-1

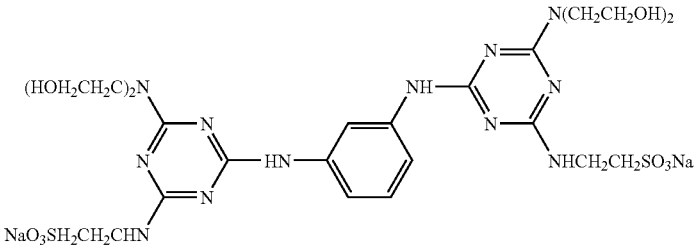

Each sample was subjected to gradation exposure to impart gray by means of the processing B and the following exposure apparatus, and further to the color development processing by the foregoing processing B after a 5-second lapse from completion of the exposure. As a laser light source, use was made of a red semiconductor laser having a wavelength of about 650 nm (Hitachi Type No. HL6501MG). Each laser light of three colors moved perpendicularly to a scanning direction by a polygon mirror such that they would carry out sequential-scanning exposure on the sample. The change of light quantity of the semiconductor laser that could be caused by the temperature change was prevented by using a Peltier device and by keeping the temperature constant. An effectual beam diameter was 80 μm, a scanning pitch was 42.3 μm (600 dpi), and the average exposure time per pixel was $1.7\times10^{-7}$ sec. The temperature of the semiconductor laser was kept constant by using a Peltier device, to prevent the quantity of light from being changed by temperature.

The density of cyan color formation of the sample that had been subjected to the processing B was measured. The fogging of the sample was found from the minimum color formation density. The sensitivity of the sample was defined as an inverse number of the exposure amount necessary to obtain a color formation density of +0.7, and expressed as a relative value when the sensitivity (S) of the sample 101 which had been subjected to the developing processing was set to 100. The gradation (γ) of each sample was measured from the inclination of the line obtained by linking the point of the density of 1.0 with the point of the density of 2.0.

The sample was irradiated with safelight using a 20 W white lamp and a SLF104 filter manufactured by Fuji Photo Film Co., Ltd., which safelight source was disposed apart from the sample by 1 m, from the reverse side of the emulsion surface for 10 minutes, followed by the aforementioned gradation exposure, processing and measurement of cyan color formation density. The density of this sample was compared with that of the same sample that was not irradiated with safelight, to express a difference in sensitivity between both at the density D=0.30 as ΔS(safelight). For example, ΔS(safelight)=0.008 means that the sample irradiated with safelight had a sensitivity higher by 0.008 log E than the sample which was not irradiated with safelight. The smaller the difference in sensitivity is, the smaller the variation in sensitivity by safelight is.

Further, the influence of a change in the condition of exposure on a variation in sensitivity was examined as follows. Specifically, a characteristic curve when the sample was subjected to exposure in the condition of 10° C.-55% RH and processed 5 seconds after, and a characteristic curve when the sample was subjected to exposure in the condition of 30° C.-30% RH and processed 5 seconds after, each were drawn, to find a difference in exposure amounts necessary to give a density of 1.5 in the conditions as a difference ΔS(light exposure) in a unit of log E.

The difference ΔS(685−590) between the spectral sensitivities at 685 nm and 590 nm and the difference ΔS(660−590) between the spectral sensitivities at 660 nm and 590 nm were found in the following manner. A spectral spectrum exposure equipment, in which an optical wedge was combined with a spectral light source obtained by combining a light source with a diffraction grating, was used to take a photograph of the spectral sensitivity spectrum of a light-sensitive material. The sensitivity of the light-sensitive material at each wavelength was measured from this photograph, and the correction of the sensitivity magnification was carried out by using an energy distribution of a sensitometer at each wavelength which the distribution was measured in advance, to find the distribution of equi-energy spectral sensitivity of the light-sensitive material. According to the distribution, each spectral sensitivity at wavelengths of 685 nm, 660 nm and 590 nm was measured in a unit of log E, to calculate each difference between the sensitivities measured at the above wavelengths.

The results are described collectively in Table 3.

TABLE 3

| Sample No. | ΔS (685-590) | ΔS (660-590) | (S) | (γ) | ΔS (safelight) | ΔS (light exposure) | Remarks |
|---|---|---|---|---|---|---|---|
| 101 | 0.98 | 0.68 | 100 | 1.89 | +0.032 | 0.29 | Comparative example |
| 102 | 1.10 | 0.75 | 116 | 1.88 | +0.031 | 0.28 | Comparative example |
| 103 | 1.42 | 0.98 | 135 | 1.94 | +0.012 | 0.18 | This invention |
| 104 | 1.60 | 1.12 | 137 | 1.95 | +0.007 | 0.17 | This invention |
| 105 | 1.56 | 1.09 | 136 | 1.94 | +0.008 | 0.15 | This invention |
| 106 | 1.52 | 1.07 | 130 | 1.93 | +0.008 | 0.14 | This invention |
| 107 | 0.97 | 0.64 | 96 | 1.85 | +0.030 | 0.30 | Comparative example |
| 108 | 1.12 | 0.76 | 110 | 1.86 | +0.031 | 0.29 | Comparative example |
| 109 | 1.39 | 1.00 | 134 | 1.92 | +0.010 | 0.19 | This invention |
| 110 | 1.63 | 1.14 | 138 | 1.96 | +0.008 | 0.16 | This invention |
| 111 | 1.58 | 1.13 | 134 | 1.96 | +0.007 | 0.14 | This invention |
| 112 | 0.97 | 0.69 | 108 | 1.65 | +0.012 | 0.27 | Comparative example |
| 113 | 1.12 | 0.74 | 120 | 1.72 | +0.011 | 0.29 | Comparative example |
| 114 | 1.41 | 1.00 | 139 | 1.82 | +0.006 | 0.18 | This invention |
| 115 | 1.61 | 1.10 | 140 | 1.79 | +0.005 | 0.16 | This invention |
| 116 | 0.97 | 0.65 | 92 | 1.90 | +0.028 | 0.28 | Comparative example |
| 117 | 1.11 | 0.78 | 98 | 1.92 | +0.029 | 0.27 | Comparative example |
| 118 | 1.43 | 0.99 | 132 | 2.02 | +0.009 | 0.16 | This invention |
| 119 | 1.62 | 1.14 | 135 | 2.10 | +0.008 | 0.17 | This invention |
| 120 | 0.96 | 0.67 | 94 | 1.91 | +0.031 | 0.29 | Comparative example |
| 121 | 1.13 | 0.76 | 99 | 1.93 | +0.030 | 0.25 | Comparative example |
| 122 | 1.38 | 0.98 | 134 | 2.01 | +0.008 | 0.20 | This invention |
| 123 | 1.43 | 1.16 | 132 | 2.12 | +0.007 | 0.17 | This invention |
| 124 | 0.95 | 0.65 | 92 | 1.89 | +0.033 | 0.27 | Comparative example |
| 125 | 1.12 | 0.71 | 96 | 1.91 | +0.034 | 0.26 | Comparative example |
| 126 | 1.39 | 0.95 | 133 | 1.98 | +0.009 | 0.18 | This invention |
| 127 | 1.40 | 1.20 | 134 | 2.10 | +0.008 | 0.15 | This invention |
| 128 | 1.13 | 0.76 | 96 | 1.91 | +0.038 | 0.29 | Comparative example |
| 129 | 1.42 | 1.01 | 132 | 2.03 | +0.010 | 0.15 | This invention |
| 130 | 1.60 | 1.13 | 131 | 2.09 | +0.009 | 0.16 | This invention |

As is apparent from Table 3, each of the samples of the comparative examples had low values of the sensitivity (S) and the gradation (γ), and was increased in the difference in sensitivity caused by safelight and in the variation of sensitivity caused by the variation of exposure condition. According to the present invention, on the other hand, it was possible to obtain a high-speed emulsion by increasing the silver iodide content. In addition, each of the samples of the present invention could be increased in the difference ΔS(685−590) between the spectral sensitivities at 685 nm and 590 nm and the difference ΔS(660−590) between the spectral sensitivities at 660 nm and 590 nm, be suppressed in the variation of sensitivity caused by safelight, and be reduced in the difference in sensitivity caused by the variation of exposure condition.

Further, it is understood that when a desensitizing gradation-hardening dopant is used in the present invention, a high-contrast silver halide light-sensitive material can be obtained.

INDUSTRIAL APPLICABILITY

The silver halide color light-sensitive material of the present invention is preferable as a silver halide color light-sensitive material that is contrasty, that is reduced in the variation of sensitivity when safelight is applied to the light-sensitive material, and that is also reduced in the variation of sensitivity that is caused by variation in the condition of exposure, in digital exposure, such as laser scanning exposure.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A silver halide color photographic light-sensitive material, having photographic constituting layers including at least one blue-sensitive layer containing a silver halide emulsion, at least one green-sensitive layer containing a silver halide emulsion, at least one red-sensitive layer containing a silver halide emulsion, and at least one hydrophilic colloidal layer, each of which is provided on a support, wherein a content of silver chloride is 95 mol % or more and a content of silver iodide is 0.05 mol % or more and 0.3 mol % or less in the silver halide emulsion of the red-sensitive layer, wherein silver halide grains in the silver halide emulsion of the red-sensitive layer are prepared by adding a metal complex represented by formula (2) and an iridium complex represented by formula (1) in this order, and wherein the difference (S1−S2) between a spectral sensitivity (S1) at a wavelength of 685 nm and a spectral sensitivity (S2) at a wavelength of 590 nm is from 1.2 to 2.5 logE, for a distribution of the spectral sensitivities when the light-sensitive material is exposed to lights equal in energy at each wavelength:

$$[Ir(X^I)_m(L^I)_{(6-m)}]^n \quad \text{Formula (1)}$$

wherein $X^I$ represents a halogen ion or a pseudo halogen ion other than a cyanate ion; $L^I$ represents an arbitrary ligand differing from $X^I$; m represents 3, 4, or 5; and n represents 5−, 4−, 3−,2−, 1−, 0, or 1+;

$$[M(X^{II})_p(L^{II})_{(6-p)}]^q \quad \text{Formula (2)}$$

wherein M represents Cr, Mo, Re, Fe, Ru, Os, Co, Rh, Pd, or Pt; $X^{II}$ represents a halogen ion; $L^{II}$ represents an arbitrary ligand differing from $X^{II}$; p represents an integer of from 3 to 6; and q represents 4−, 3−, 2−, 1−, 0, or 1+.

2. A The silver halide color photographic light-sensitive material according to claim 1, wherein the difference (S3−S2) between a spectral sensitivity (S3) at a wavelength of 660 nm and a spectral sensitivity (S2) at a wavelength of 590 nm is from 0.8 to 2.0 logE, for a distribution of the spectral sensitivities when the light-sensitive material is exposed to lights equal in energy at each wavelength.

3. The silver halide color photographic light-sensitive material according to claim 2, wherein the difference (S1−S2) is from 1.4 to 2.5 logE and the difference (S3−S2) is from 1.0 to 2.0 logE.

4. The silver halide color photographic light-sensitive material according to claim 2, wherein the content of silver iodide in the silver halide emulsion of the red-sensitive layer is 0.07 mol % or more and 0.3 mol % or less.

5. The silver halide color photographic light-sensitive material according to claim 1, wherein the content of silver iodide in the silver halide emulsion of the red-sensitive layer is 0.07 mol % or more and 0.3 mol % or less.

6. The silver halide color photographic light-sensitive material according to claim 1, wherein the difference (S1−S2) is from 1.4 to 2.5 logE.

7. The silver halide color photographic light-sensitive material according to claim 1, wherein $L^I$ is a 5-membered heterocyclic compound having at least one nitrogen atom and at least one sulfur atom in its 5-membered ring skeleton.

8. The silver halide color photographic light-sensitive material according to claim 1, wherein $L^{II}$ is $H_2O$, NO or NS.

9. The silver halide color photographic light-sensitive material according to claim 1, wherein the silver halide grains in the silver halide emulsion of the red-sensitive layer further contain a hexacyano metal complex represented by formula (3):

$$[(M^{III})(CN)_6]^s \qquad \text{Formula (3)}$$

wherein, $M^{III}$ represents a metal selected from the group consisting of iron, ruthenium, osmium, cobalt and iridium; and s represents 3−or 4−.

10. The silver halide color photographic light-sensitive material according to claim 9, wherein the silver halide grains in the silver halide emulsion of the red-sensitive layer are prepared by adding the hexacyano metal complex represented by formula (3) at a time after the addition of the metal complex represented by formula (2) and before addition of the iridium complex represented by formula (1).

11. The silver halide color photographic light-sensitive material according to claim 1, wherein the silver halide grains in the silver halide emulsion of the red-sensitive layer contain at least two kinds of the iridium complex represented by formula (1).

12. The silver halide color photographic light-sensitive material according to claim 1, wherein the silver halide grains in the silver halide emulsion of the red-sensitive layer contain at least three kinds of the iridium complex represented by formula (1).

13. The silver halide color photographic light-sensitive material according to claim 1, wherein the silver halide grains in the silver halide emulsion of the red-sensitive layer contain at least two kinds of the iridium complex represented by formula (1), wherein $L^I$ in one kind of the iridium complex represented by formula (1) is a 5-membered heterocyclic compound having at least one nitrogen atom and at least one sulfur atom in its 5-membered ring skeleton and $L^I$ in another kind of the iridium complex represented by formula (1) is $H_2O$.

14. A silver halide color photographic light-sensitive material, having photographic constituting layers including at least one blue-sensitive layer containing a silver halide emulsion, at least one green-sensitive layer containing a silver halide emulsion, at least one red-sensitive layer containing a silver halide emulsion, and at least one hydrophilic colloidal layer, each of which is provided on a support, wherein a content of silver chloride is 95 mol % or more and a content of silver iodide is 0.05 mol % or more and 0.3 mol % or less in the silver halide emulsion of the red-sensitive layer, wherein silver halide grains in the silver halide emulsion of the red-sensitive layer are prepared by adding a metal complex represented by formula (2) and an iridium complex represented by formula (1) in this order; and wherein the difference (S3−S2) between a spectral sensitivity (S3) at a wavelength of 660 nm and a spectral sensitivity (S2) at a wavelength of 590 nm is from 0.8 to 2.0 logE, for a distribution of the spectral sensitivities when the light-sensitive material is exposed to lights equal in energy at each wavelength:

$$[Ir(X^I)_m(L^I)_{(6-m)}]^n \qquad \text{Formula (1)}$$

wherein $X^I$ represents a halogen ion or a pseudo halogen ion other than a cyanate ion; $L^I$ represents an arbitrary ligand differing from $X^I$; m represents 3, 4, or 5; and n represents 5−, 4−, 3−,2−, 1−, 0, or 1+;

$$[M(X^{II})_p(L^{II})_{(6-p)}]^q \qquad \text{Formula (2)}$$

wherein M represents Cr, Mo, Re, Fe, Ru, Os, Co, Rh, Pd, or Pt; $X^{II}$ represents a halogen ion; $L^{II}$ represents an arbitrary ligand differing from $X^{II}$; p represents an integer of from 3 to 6; and q represents 4−, 3−, 2−, 1−, 0, or 1+.

15. The silver halide color photographic light-sensitive material according to claim 14, wherein the difference (S3−S2) is from 1.0 to 2.0 logE.

16. The silver halide color photographic light-sensitive material according to claim 14, wherein the content of silver iodide in the silver halide emulsion of the red-sensitive layer is 0.07 mol % or more and 0.3 mol % or less.

17. The silver halide color photographic light-sensitive material according to claim 14, wherein $L^I$ is a 5-membered heterocyclic compound having at least one nitrogen atom and at least one sulfur atom in its 5-membered ring skeleton.

18. The silver halide color photographic light-sensitive material according to claim 14, wherein $L^{II}$ is $H_2O$, NO or NS.

19. The silver halide color photographic light-sensitive material according to claim 14, wherein the silver halide grains in the silver halide emulsion of the red-sensitive layer further contain a hexacyano metal complex represented by formula (3):

$$[(M^{III})(CN)_6]^s \qquad \text{Formula (3)}$$

wherein, $M^{III}$ represents a metal selected from the group consisting of iron, ruthenium, osmium, cobalt and iridium; and s represents 3−or 4−.

20. The silver halide color photographic light-sensitive material according to claim 19, wherein the silver halide grains in the silver halide emulsion of the red-sensitive layer are prepared by adding the hexacyano metal complex represented by formula (3) at a time after the addition of the metal complex represented by formula (2) and before addition of the iridium complex represented by formula (1).

21. The silver halide color photographic light-sensitive material according to claim 14, wherein the silver halide grains in the silver halide emulsion of the red-sensitive layer contain at least two kinds of the iridium complex represented by formula (1).

22. The silver halide color photographic light-sensitive material according to claim 14, wherein the silver halide grains in the silver halide emulsion of the red-sensitive layer contain at least three kinds of the iridium complex represented by formula (1).

23. The silver halide color photographic light-sensitive material according to claim 14, wherein the silver halide grains in the silver halide emulsion of the red-sensitive layer contain at least two kinds of the iridium complex represented by formula (1), wherein $L^I$ in one kind of the iridium complex represented by formula (1) is a 5-membered heterocyclic compound having at least one nitrogen atom and at least one sulfur atom in its 5-membered ring skeleton and $L^I$ in another kind of the iridium complex represented by formula (1) is $H_2O$.

* * * * *